US008465013B2

(12) United States Patent
Ashikawa

(10) Patent No.: US 8,465,013 B2
(45) Date of Patent: Jun. 18, 2013

(54) CARRYING APPARATUS, IMAGE FORMING APPARATUS, CARRIED MEDIUM CARRYING METHOD, COMPUTER READABLE MEDIUM STORING COMPUTER PROGRAM THEREOF

(75) Inventor: Masahiro Ashikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 367 days.

(21) Appl. No.: 12/876,276

(22) Filed: Sep. 7, 2010

(65) Prior Publication Data

US 2011/0064496 A1 Mar. 17, 2011

(30) Foreign Application Priority Data

Sep. 11, 2009 (JP) ..... 2009-210978
Jul. 28, 2010 (JP) ..... 2010-169709

(51) Int. Cl.
*B65H 83/00* (2006.01)

(52) U.S. Cl.
USPC ..... 271/3.18; 271/270

(58) Field of Classification Search
USPC ..... 271/3.18, 264, 270
See application file for complete search history.

(56) References Cited

U.S. PATENT DOCUMENTS 3,829,745 A * 8/1974 Ha et al. ..... 361/246
7,183,730 B2 * 2/2007 Vazquez et al. ..... 318/400.01
7,931,274 B2 * 4/2011 Krucinski ..... 271/264
2009/0212483 A1 * 8/2009 Maruyama ..... 271/111
2010/0034565 A1 2/2010 Ashikawa et al.

FOREIGN PATENT DOCUMENTS

| | | |
|---|---|---|
| JP | 2000-056529 | 2/2000 |
| JP | 2004-310261 | 11/2004 |
| JP | 2005-269758 | 9/2005 |
| JP | 2008-065133 | 3/2008 |
| JP | 2008-083139 | 4/2008 |
| JP | 2008-158076 | 7/2008 |

* cited by examiner

*Primary Examiner* — Michael McCullough
(74) *Attorney, Agent, or Firm* — IPUSA, PLLC

(57) ABSTRACT

A disclosed carrying apparatus includes a first rotating unit carrying a sheet-like carried medium in a rotating direction, a second rotating unit carrying the carried medium in the rotating direction, a first driving unit rotating the first rotating unit, a second driving unit rotating the second rotating unit, a first rotational speed detecting unit, a second rotational speed detecting unit, a first rotational speed controlling unit, a second rotational speed controlling unit, and a torque information acquiring unit acquiring torque information acting on the first rotating unit, wherein the second rotational speed controlling unit controls the second rotational speed in response to a comparison result between the torque information acquired when the sheet-like carried medium is solely carried by the first rotating unit and the torque information acquired when the sheet-like carried medium is carried by the first rotating unit and the second rotating unit.

18 Claims, 29 Drawing Sheets

CARRYING APPARATUS, IMAGE FORMING APPARATUS, CARRIED MEDIUM CARRYING METHOD, COMPUTER READABLE MEDIUM STORING COMPUTER PROGRAM THEREOF

BACKGROUND OF THE INVENTION

1. Field of the Invention

The present invention generally relates to a carrying apparatus for carrying a sheet-like carried medium, particularly a carrying apparatus, an image forming apparatus, a carried medium carrying method, and a computer readable medium storing a computer program which enable control of a rotational speed of a carrying rotational measure for carrying the carried medium.

2. Description of the Related Art

An example of an image forming apparatus transfers a toner image formed on an intermediate transferring belt or a photoreceptor drum to a recording paper in a transferring unit, and then fixes the toner image to the recording paper. In the transferring unit, the transferring roller presses the recording paper against the intermediate transferring belt or the photoreceptor drum. There is a fuser device on a downstream side of the transferring unit. When the size of the recording paper becomes a predetermined size or more, the recording paper reaches the fuser device while the recording paper is interposed between the transferring roller and the intermediate transferring belt. Since the rotational speed of the fuser roller of the fuser device and the rotational speed of the transferring roller are separately controlled, when the recording paper bridges the transferring roller and the fuser roller, the recording paper may be pulled by the fixing device or pushed by a secondary transferring roller to exchange torque due to a slight difference between the rotational speeds of the transferring roller and the fuser roller.

When the torque is exchanged between two rollers, an image quality is deteriorated or a color shift may occur due to a slippage of any one of the rollers. Specifically, when the weighting capacity, i.e. the weight per unit area, of the recording paper is large like a dense recording paper or a thick recording paper, the recording paper may be slipped by pushing of the recording paper when the circumferential velocity of the roller on the upstream side is higher than the circumferential velocity of the roller on the downstream side.

Patent Document 1 discloses an image forming apparatus which corrects the rotational speed of a fuser roller each predetermined time using a result of comparing an appropriate loop amount with an actual loop amount.

However, in the image forming apparatus disclosed in Patent Document 1, there is a problem that the appropriate loop amount is required to be stored in advance, and a correction amount of the rotational speed of the fuser roller may depend on the appropriate loop amount. Therefore, there is no assurance that the rotational speed of the fuser roller controlled by the result of comparing the appropriate loop amount with the actual loop amount is accurate. Specifically, it is difficult to form a loop in a recording paper having a large weighing capacity.

Patent Document 1: Japanese Laid-Open Patent Application No. 2008-158076

SUMMARY OF THE INVENTION

Accordingly, embodiments of the present invention provide a novel and useful carrying apparatus, a novel and useful image forming apparatus, a novel and useful carried medium carrying method, and a novel and useful computer readable medium storing a computer program which enable a reduction of an exchange of torques between two rollers for carrying recording papers solving one or more of the problems discussed above.

More specifically, the embodiments of the present invention may provide a carrying apparatus including a first rotating unit configured to carry a sheet-like carried medium in a rotating direction; a second rotating unit configured to carry the sheet-like carried medium in the rotating direction, the second rotating unit being arranged in an upper or lower stream side of the first rotating unit; a first driving unit configured to rotate the first rotating unit; a second driving unit configured to rotate the second rotating unit; a first rotational speed detecting unit configured to detect a first rotational speed of the first rotating unit; a second rotational speed detecting unit configured to detect a second rotational speed of the second rotating unit; a first rotational speed controlling unit configured to control the first rotational speed to be a first target speed; a second rotational speed controlling unit configured to control the second rotational speed to be a second target speed; and a torque information acquiring unit configured to acquire torque information of torque acting on the first rotating unit, wherein the second rotational speed controlling unit controls the second rotational speed in response to a comparison result between the torque information acquired by the torque information acquiring unit when the sheet-like carried medium is solely carried by the first rotating unit and the torque information acquired by the torque information acquiring unit when the sheet-like carried medium is carried by the first rotating unit and the second rotating unit.

Additional objects and advantages of the embodiments will be set forth in part in the description which follows, and in part will be obvious from the description, or may be learned by practice of the invention. Objects and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to the FIG. 1 through FIG. 22C of embodiments of the present invention.

Reference symbols typically designate as follows:

12: fuser roller;
14: intermediate transferring belt;
15: tension roller;
17: repulsive force roller;
18: secondary transferring roller;
20: intermediate transferring roller;
33: resist roller;
50: secondary transferring unit;
53: recording paper;
61: intermediate transferring motor;
63: secondary transferring encoder;
64: secondary transferring motor;
65: fuser encoder;
66: fuser motor;
67: torque sensor;
71A: secondary transferring motor control unit;
71A: fuser motor control unit;
71C: intermediate transferring motor control unit;
71D: resist motor control unit;
74: secondary transferring motor controller;
75: fuser motor controller;
76: torque control unit;
87: intermediate transferring motor controller;
91: resist motor controller;
93: resist encoder;
94: resist motor;
100: image forming apparatus; and
200: control device.

Embodiment 1

Portions of an image forming apparatus 100 are schematically described. The image forming apparatus 100 of Embodiment 1 decreases an exchange of torque between a secondary roller 18 and a fuser roller 12 by measuring the torque of the secondary roller 18 and correcting the rotational speed of the fuser roller 12 in response to a variation of the torque caused by the exchange of the torque. Since the rotational speed of the fuser roller 12 is corrected in response to the variation of the measured torque, it is possible to reduce the exchange of the torque between the two rollers 12 and 18 and prevent the recording paper from being pulled and pushed. For example, when a recording paper has a large weighting capacity, the torque may vary and the correction amount of the rotational speed of the fuser roller 12 increases. Therefore, regardless of the value of the weighing capacity, it is possible to reduce the exchange of the torque between the two rollers. Therefore, it is possible to prevent an image quality degradation caused by the exchange of the torque. The recording paper is ordinarily a plain paper. However, the recording paper may any paper be in a sheet-like shape such as a glossy paper, a heavy paper, a paper like post card, an OHP sheet, and a film.

(Schematic Structure of the Image Forming Apparatus)

Figure 1:
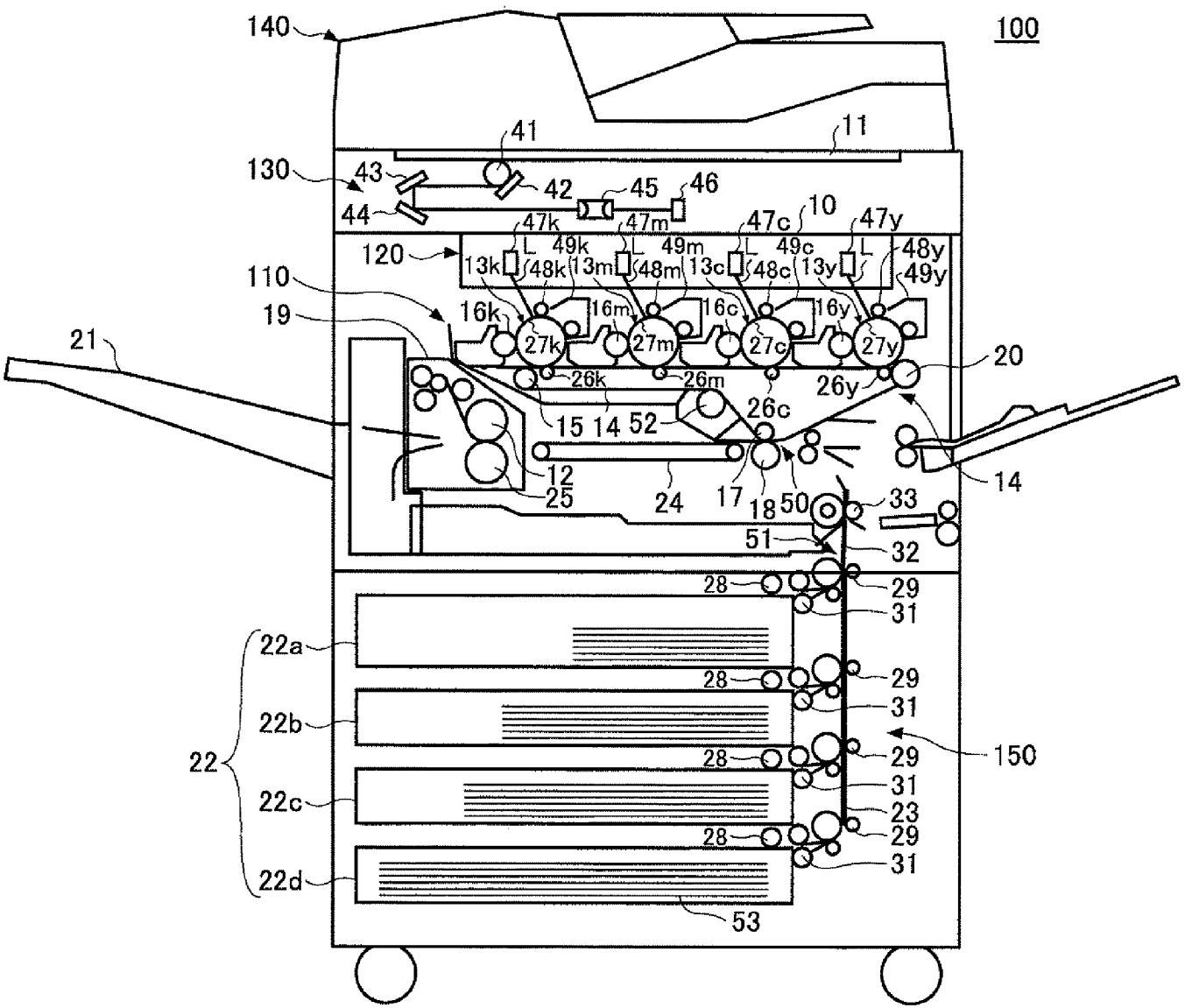
FIG. 1 illustrates an example entire structure of an image forming apparatus.

FIG. 1 illustrates an example entire structure of an image forming apparatus 100. The image forming apparatus 100 includes an automatic document feeder (ADF) 140, an image reading unit 130, a writing unit 110, an image forming unit 120, and a paper feeder unit 150. The ADF 140 transfers manuscripts loaded on a manuscript supplying tray one by one on a contact glass of an image reading unit, and ejects the manuscripts after the image data of the manuscripts are read out.

The image reading unit 130 includes a contact glass 11 for mounting the manuscripts on it, and an optical scanning system. The optical scanning system includes an exposure lamp 41, a first mirror 42, a second mirror 43, a third mirror 44, a lens 45, and a full color CCD 46. The exposure lamp 41 and the first mirror 42 are provided in a first carriage, and the first carriage is moved in a sub-scanning direction at a constant speed by a stepping motor when the manuscripts are read. The second mirror 43 and the third mirror 44 are provided in a second carriage. The second carriage is moved substantially at a half speed of the first carriage by the stepping motor when the manuscripts are read. By the motion of the first and second carriages, image faces of the manuscripts are optically scanned, and the read data form an image on a light receiving face of a full color CCD 46 with a lens and are subjected to photoelectric conversion.

The image data subjected to the photoelectric conversion into colors of red (R), green (G) and blue (B) with the full color CCD (a full color line CCD may be instead used) are provided with various kinds of image processing such as gamma correction, color conversion, image separation, and tone correction.

When a user indicates a copy operation or the image forming apparatus 100 is used as a printer, the writing unit 110 forms a latent image on a photoreceptor drum for each color. In FIG. 1, four photoreceptor units 13 including a yellow photoreceptor unit 13*y*, a magenta photoreceptor unit 13*m*, a cyan photoreceptor unit 13*c*, and a black photoreceptor unit 13*k* are arranged along a carrying direction of the intermediate transferring belt 14. The photoreceptor units 13*y*, 13*m*, 13*c* and 13*k* include drum-like photoreceptor drums 27*y*, 27*m*, 27*c* and 27*k* as an image holding body, charging devices 48*y*, 48*m*, 48*c* and 48*k* for charging the photoreceptor drums 27*y*, 27*m*, 27*c* and 27*k*, exposing devices 47*y*, 47*m*, 47*c* and 47*k*, developing devices 16*y*, 16*m*, 16*c* and 16*k*, and cleaning devices 49*y*, 49*m*, 49*c* and 49*k*.

For example, the exposing devices 47*y*, 47*m*, 47*c* and 47*k* function in a LED writing method using a light emitting diode (LED) array arranged in the axial direction (i.e. a main scanning direction) of the photoreceptor drums 27*y*, 27*m*, 27*c* and 27*k* and a lens array. The exposing devices 47*y*, 47*m*, 47*c* and 47*k* make the LED emit light in correspondence with the image data subjected to the photoelectric conversion into the four colors to form latent images on the photoreceptor drums 27*y*, 27*m*, 27*c* and 27*k*. The developing devices 16*y*, 16*m*, 16*c* and 16*k* form toner images for the respective colors when the developing rollers rotate while holding developer on them to cause the latent images on the photoreceptor drums 27*y*, 27*m*, 27*c* and 27*k* to be made visible with toner.

The toner images formed on the photoreceptor drums 27*y*, 27*m*, 27*c* and 27*k* are transferred onto the intermediate transferring belt 14 at positions (hereinafter, referred to as first transferring positions) where the photoreceptor drums 27*y*, 27*m*, 27*c* and 27*k* are in contact with the intermediate transferring belt 14. The intermediate transferring rollers 26*y*, 26*m*, 26*c* and 26*k* are placed opposite the photoreceptor drums 27*y*, 27*m*, 27*c* and 27*k* interposing the intermediate transferring belt 14 between the intermediate transferring rollers and the photoreceptor drums. Further, the intermediate transferring rollers 26*y*, 26*m*, 26*c* and 26*k* are placed opposite the photoreceptor units 13*y*, 13*m*, 13*c* and 13*k*. The intermediate transferring rollers 26*y*, 26*m*, 26*c* and 26*k* are in contact with an inner peripheral face of the intermediate transferring belt 14. The intermediate transferring belt 14 as in contact with the faces of the photoreceptor drums 27*y*, 27*m*, 27*c* and 27*k*. By applying voltages to the intermediate transferring rollers 26*y*, 26*m*, 26*c* and 26*k*, intermediate transferring electric fields are generated in the intermediate transferring belt 14 for transferring the toner images of the photoreceptor drums 27*y*, 27*m*, 27*c* and 27*k* to the intermediate transferring belt 14. By the function of the intermediate transferring electric field, the toner images are formed on the intermediate transferring belt 14. The toner images of the four colors are superposed and transferred to thereby form a full color toner image on the intermediate transferring belt 14.

After the images of the four colors are formed and transferred, the recording paper 53 is supplied from a paper feeding tray 22 while matching timings with the intermediate transferring belts. Thus, the toner images of the four colors are secondarily transferred to the recording paper 53 from the intermediate transferring belt 14 in the secondary transferring unit 50.

The recording paper 53 is selectively supplied from any one of a first tray 22*a*, a second tray 22*b*, a third tray 22*c*, a fourth tray 22*d*, and a double-sided unit (not illustrated). The paper feed trays 22*a* to 22*d* each includes a paper feeding roller 28 which sequentially sends recording papers from an uppermost one of the recording papers, and a separating roller 31 which sends the plural recording papers to a common carry passage 23 after separating the overlapping recording papers sent from the paper feeding roller 28 one by one. The recording papers 53 are started to be carried toward the carry passage 23.

The paper feeder unit 150 has plural pairs of carrying rollers 29 provided in the way of the carry passage 23. The pairs of carrying rollers 29 sends a recording paper delivered from the paper feeding tray 22 to pairs of carrying rollers 29 in later stages and a paper feed path 32. The recording paper sent into the paper feed path 32 is once stopped by abutting on the resist roller 33 when a predetermined time passes after a tip of the recording paper 53 is detected by the resist sensor 51. The resist roller 33 feeds the sandwiched recording paper 53 to a position of the secondary roller 18 at a predetermined timing in synchronism with a vertical scanning effective period signal (FGATE). The predetermined timing is a timing when the superposed toner images of the full colors are carried to the position of the secondary roller 18 by the rotation of the intermediate transferring belt 14.

The secondary roller 18 is placed opposite the repulsive force roller 17 relative to the intermediate transferring belt 14. The image forming apparatus 100 causes the secondary roller 18 to be in contact with the intermediate transferring belt 14 at the time of printing. The outer circumferential speed of the secondary roller 18 is controlled to be the same as the surface speed of the intermediate transferring belt 14 by the secondary motor 64.

After the recording paper 53 is separated by a separator (not illustrated) by the intermediate transferring belt 14, the recording paper 53 is carried by a carry belt 24 to a fuser device 19. In a case of single-side printing, the recording paper 53 is ejected on a catch tray 21.

In Embodiment 1, although the image is formed in the recording paper 53 by the above-mentioned electrophotographic method, it is possible to adopt an ink jet method, a sublimation thermal transfer method, or a dot impact method in the image forming unit 120. Said differently, Embodiment 1 has a characteristic in the carrying method of the recording papers and is not limited by the image forming method.

Figure 2:
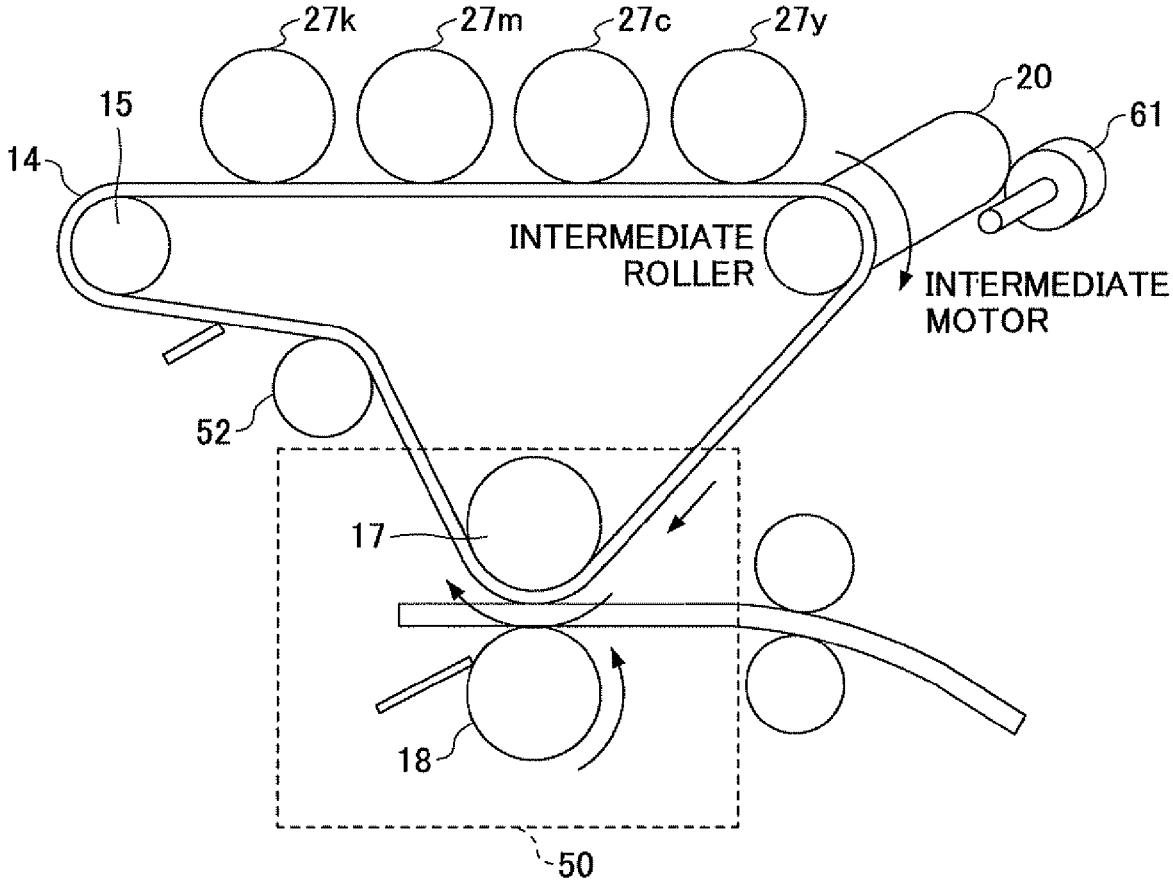
FIG. 2 illustrates an example structure of a secondary transferring unit including an intermediate transferring belt in the image forming apparatus.

FIG. 2 illustrates an example structure of the secondary transferring unit 50 including the intermediate transferring belt 14 in the image forming apparatus 100. In FIG. 2, explanations which are the same as those of FIG. 1 are omitted. The intermediate transferring belt 14 is driven by a rotational force of the intermediate roller 20 in the direction of the arrow. The intermediate roller 20 is rotated by the intermediate motor 61. The intermediate roller 20 and the intermediate motor 61 have coaxially provided gears which mutually engage to transmit the driving force of the intermediate motor 61 to the intermediate roller 20. The tension roller 15 and the repulsive force roller 17 located inside the intermediate transferring belt 14 are driven rollers driven in response to the rotation of the intermediate roller 20. The tension roller 15 is a roller which applies a predetermined tension to the intermediate transferring belt 14. The intermediate roller 20 may be arranged in place of the tension roller 15. The roller 52 adjusts contacts among the three rollers 15, 17 and 20 and the intermediate transferring belt 14 and the position of the intermediate transferring belt 14.

Figure 3:
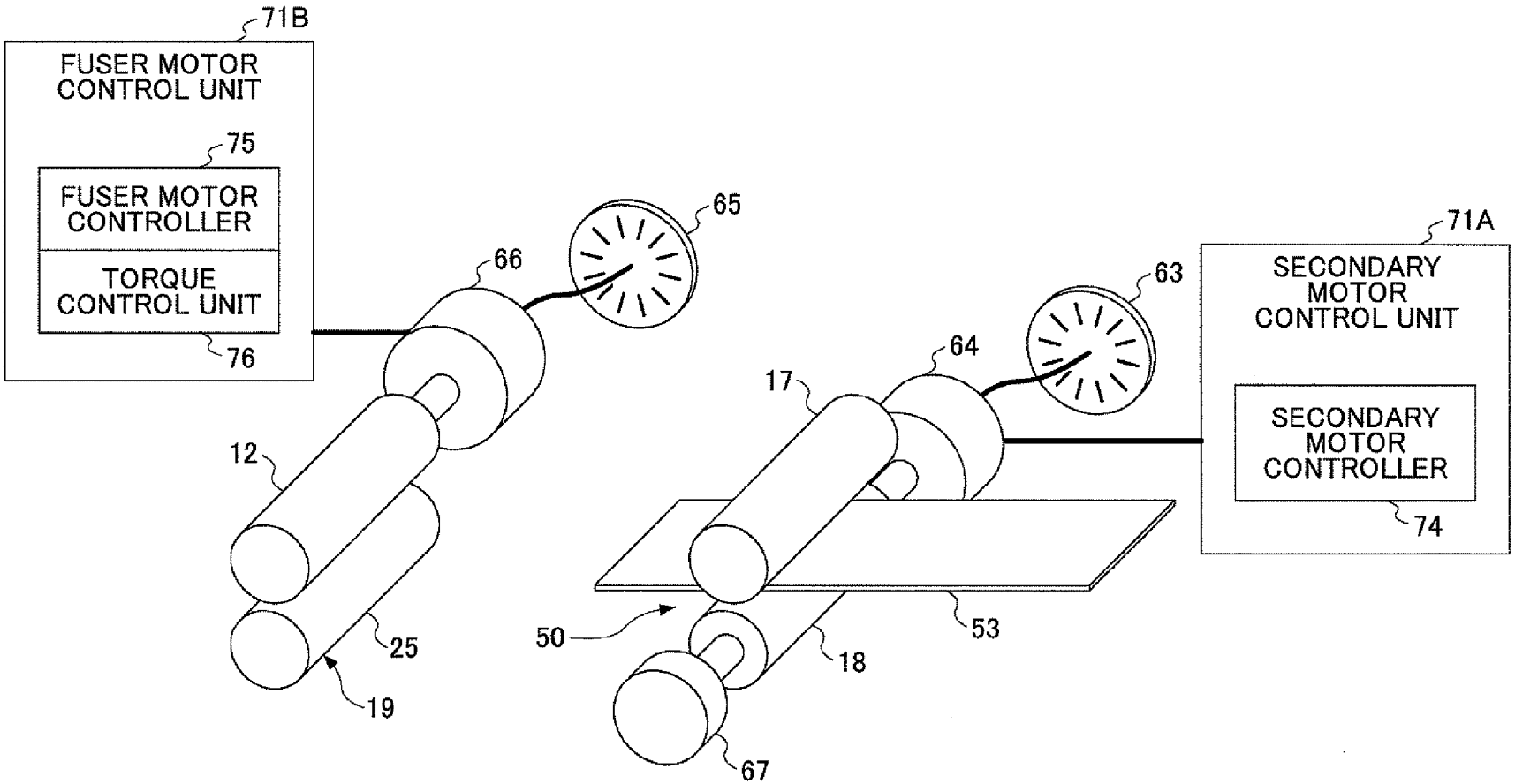
FIG. 3 illustrates schematic structures of a secondary transferring unit and a fuser device.

FIG. 3 illustrates an example of schematic structures of the secondary transferring unit 50 and the fuser device 19. In FIG. 3, the intermediate transferring belt 14 is omitted. The secondary roller 18 is rotated by the rotational force of the secondary motor 64. In FIG. 3, the secondary motor 64 is connected to the secondary roller 18 so that a rotational shaft of the secondary roller 18 and a rotational shaft of the secondary motor 64 are coaxial. This transmission method of the driving force is an example, and the secondary roller 18 may rotate by a transmitting force obtained by engaging a pair of gears rotating around rotational axes of the secondary roller 18 and the secondary motor 64.

The secondary transferring encoder 63 is provided in the secondary motor 64 to detect the speed of the secondary roller 18. The secondary encoder 63 detects the number of slits passing through the sensor per unit time, determines the rotational speed of the secondary roller 18 based on the number, and outputs the determined rotational speed to a secondary motor control unit 71A. The secondary encoder 63 may be a frequency generator (FG) which outputs a pulse signal having a frequency corresponding to the rotational speed of the secondary motor 64.

A torque sensor 67 is provided in the secondary roller 18 to detect the torque acting on the secondary roller 18. Although the torque sensor 67 is described later, the torque exchanged between the secondary roller 18 and a fuser roller 12 can be detected by the torque sensor 67.

The secondary roller 18 is arranged so as to face the repulsive force roller 17 via the intermediate transferring belt 14.

The secondary roller 18 is biased in a direction of the repulsive force roller 17. When the recording paper 53 passes between the secondary roller 18 and the intermediate transferring belt 14, the recording paper 53 is sandwiched by the secondary roller 18 and the repulsive force roller 17. The secondary roller 18 secondarily transfers the toner image on the intermediate transferring belt 14 to the recording paper 53 by a sandwiching pressure and a secondary transferring electric field generated by a voltage applied to the secondary roller 18.

Further, the fuser device 19 for fusing the toner images onto the recording paper 53 to which the toner image is transferred is provided on the downstream side of the secondary transferring unit 50 of the carrying direction of the recording paper 53. The fuser device 19 has the fuser roller 12 and a pressure roller 25. The fuser roller 12 is rotated by the rotational force of the fuser motor 66. Referring to FIG. 3, a rotational shaft of the fuser roller 12 and a rotational shaft of the fuser motor 66 are coaxial. A fuser encoder 65 is provided in the fuser roller 12 to enable detecting the rotational speed of the fuser roller 12. The fuser encoder 65 detects the number of slits passing through the sensor per unit time, determines the rotational speed of the fuser roller 12 based on the number, and outputs the determined rotational speed to a fuser motor control unit 71B.

The recording paper 53 having a size in the carrying direction larger than a predetermined size comes into the fuser device 19 before the recording paper 53 finishes passing by the secondary transferring unit 50. In this case, the recording paper 53 bridges between the secondary transferring unit 50 and the fuser device 19, and there is a torque exchange between the secondary transferring unit 50 and the fuser device 19. The image forming apparatus 100 of Embodiment 1 reduces the exchange of torque. The expression "bridge" means that the recording paper 53 is simultaneously sandwiched by the rollers 17 and 18 and the rollers 25 and 12 with a force larger than 0.

(Exchange of Torques)

Figure 4A:
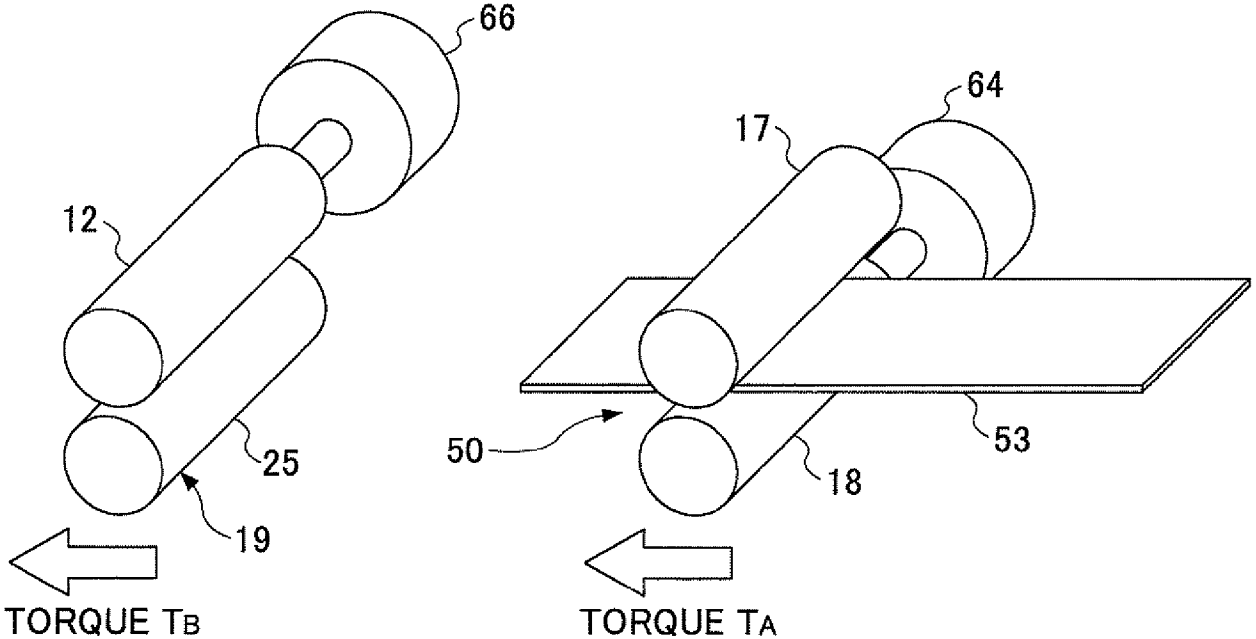
FIG. 4A schematically illustrates torque exchanged between the secondary roller and the fuser roller via a recording paper.
Figure 4B:
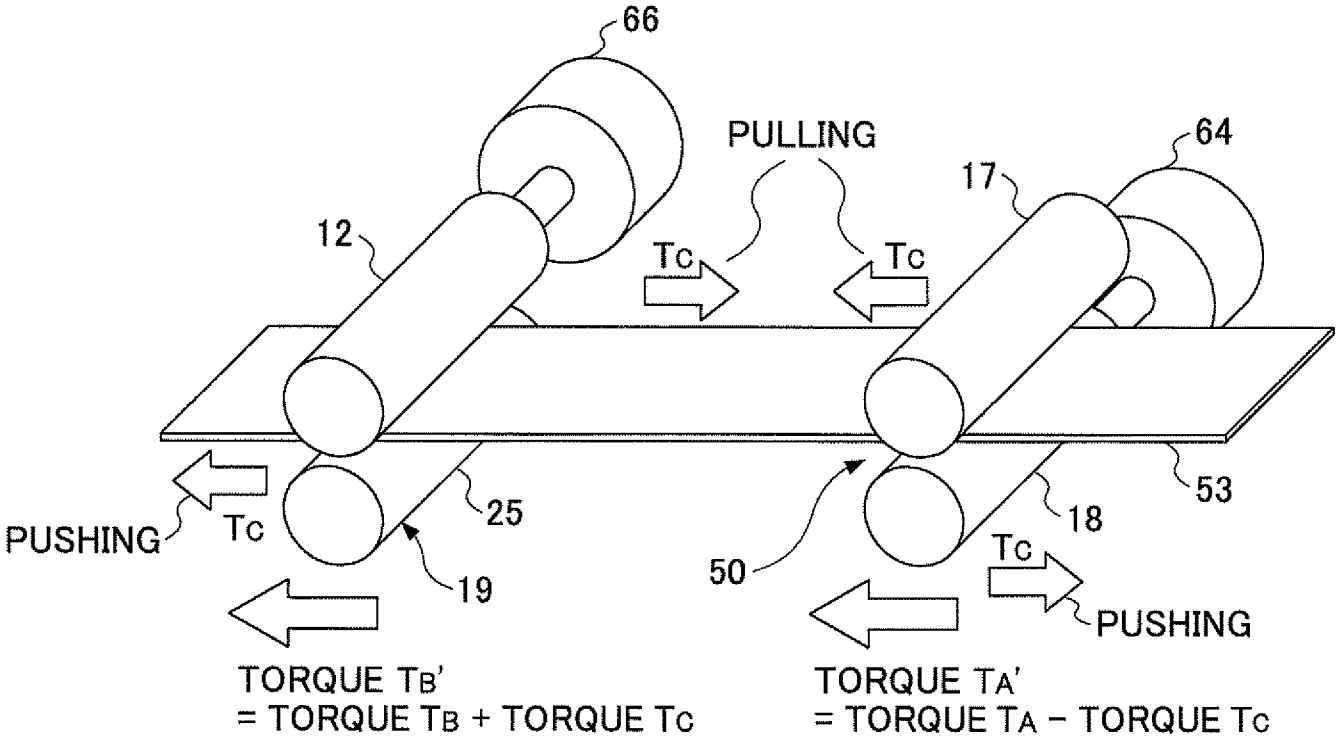
FIG. 4B schematically illustrates the torque exchanged between the secondary roller and the fuser roller via a recording paper.
Figure 4C:
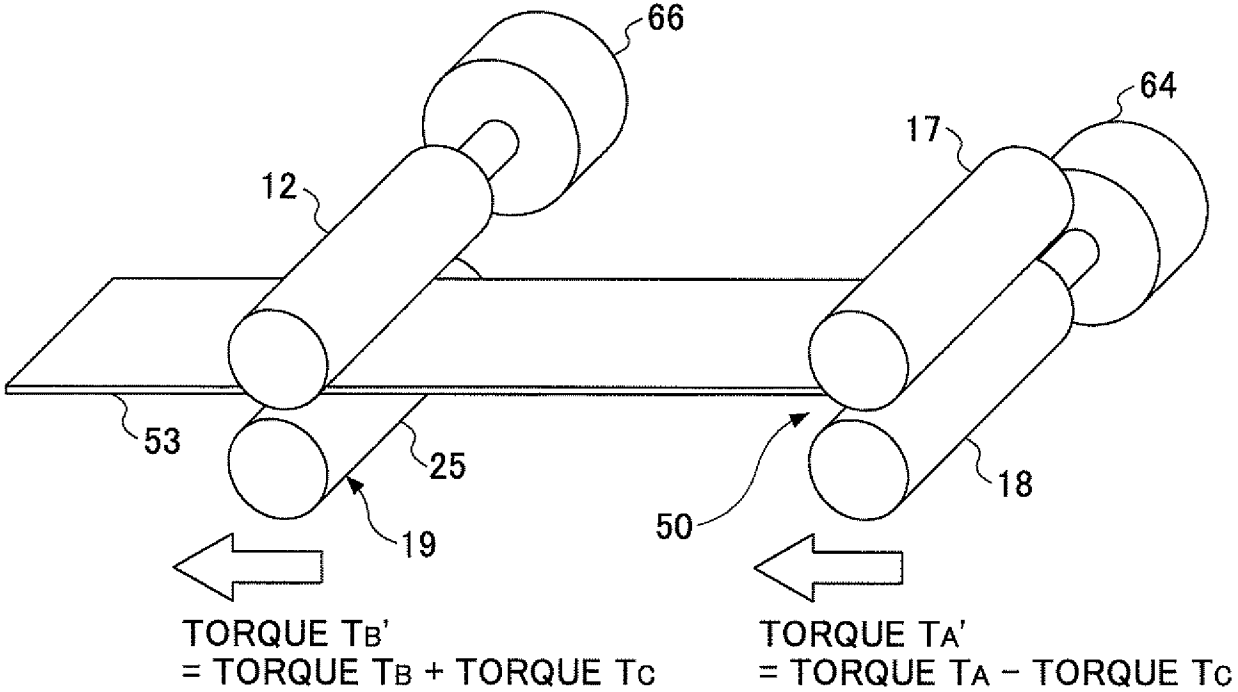
FIG. 4C schematically illustrates the torque exchanged between the secondary roller and the fuser roller via a recording paper.

The exchange of the torque between the secondary transferring unit 50 and the fuser device 19 is described next. FIG. 4A illustrates the recording paper 53 solely carried by the secondary roller 18 with the aid of the repulsive force roller 17. FIG. 4B illustrates the recording paper 53 carried while bridging between the secondary transferring unit 50 and the fuser device 19. FIG. 4C illustrates the recording paper 53 carried by only the fuser device 19.

When the recording paper 53 is carried by only the secondary roller 18, the rotational speed $V_1$ (rad/s) of the secondary roller 18 and the rotational speed $V_2$ (rad/s) of the fuser roller 12 may be expressed as follows. Here, the friction resistance or the like is ignored for simplicity.

The motion equation is torque (N/m)=rotational inertia moment J (kg·m$^2$)×angular acceleration α (rad/s$^2$). Therefore, the rotational speed V (rad/s) is $\int\{T/J\}$. Provided that the radius of a rotating body is r, the outer circumferential speed of the rotating body=rotational speed V×radius r. It is designed that the outer circumferential speeds of the secondary roller 18 and the fuser roller 12 are substantially the same in response to the radiuses r of the secondary roller 18 and the fuser roller 12.

$$V_1=\int\{T_A/J_A\}, \text{ and} \quad \text{Formula 1}$$

$$V_2=\int\{T_B/J_B\}, \quad \text{Formula 2}$$

where, $T_A$ designates a driving torque of the secondary motor 64. $T_B$ designates a driving torque of the fuser motor 66. $J_A$ designates a rotational inertia moment of the secondary roller 18. $J_B$ designates a rotational inertia moment of the fuser roller 12. When the rotational inertia moment $J_A$ of the secondary roller 18 is constant without generating a load variation, the secondary motor 64 may maintain the rotational speed of the secondary roller 18 to be $V_1$ with a predetermined driving torque $T_A$. When the rotational inertia moment $J_B$ of the fuser roller 12 is constant without generating a load variation, the fuser motor 66 may maintain the rotational speed of the fuser roller 18 to be $V_2$ with a predetermined driving torque $T_B$.

Referring to FIG. 4B, when the recording paper 53 bridges between the secondary transferring unit 50 the fuser device 19, the recording paper 53 is pulled or pushed between two rollers rotated at speeds which are not completely the same. Referring to FIG. 4B, a force by pulling and pushing is designated as torque $T_C$. When the pushing force acts from the secondary roller 18 to the fuser roller 12, a torque $T_C$ acts on the fuser roller 12 in the left direction with the action-reaction law, and a torque $T_C$ acts on the secondary roller 18 in the right direction. The torque $T_C$ takes a positive value along the leftward direction in consideration of positive and negative of the torques $T_A$ and $T_B$. When the pushing force acts on the fuser roller 12 from the secondary roller 18, the positive torque $T_C$ acts on the fuser roller 12 in the left direction. Thus, the torque $T_C$ acts on the secondary roller 18 in the right direction. On the contrary, when the fuser roller 12 pulls the recording paper 53 from the secondary roller 18, the negative torque $T_C$ acts on the fuser roller 12 in the right direction as a tensile force, and the positive torque $T_C$ counter-acts on the secondary roller 18 in the left direction.

Referring to FIG. 4B, the driving torque $T_A'$ of the secondary motor 64 and the driving torque $T_B'$ of the fuser motor 66 are as follows.

$$T_A'=T_A-T_C \quad \text{Formula 3}$$

$$T_B'=T_B+T_C \quad \text{Formula 4}$$

When Formulas 3 and 4 are substituted for Formulas 1 and 2, the rotational speed $V_1'$ of the secondary roller 18 and the rotational speed $V_2'$ of the fuser roller 12 are expressed by the following formulas. Here, the friction resistance or the like is ignored for simplicity.

$$V_1'=\int\{T_A'+T_C/J_A\}, \text{ and} \quad \text{Formula 5}$$

$$V_2'=\int\{T_B'-T_C/J_B\}, \quad \text{Formula 6}$$

where $T_A'$ designates a torque being applied to the secondary roller 18 and being a part of the driving torque of the secondary motor 64, and $T_B'$ designates a torque applied to the fuser roller 12 among the driving torque of the fuser motor 66.

Therefore, when both Formulas 3 and 4 can be established, even if the recording paper 53 is pulled or pushed between the two rollers, the rotational speed $V_1$ of the secondary roller 18 and the rotational speed $V_2$ of the fuser roller 12 do not change. Therefore, the following relationships are established.

$$V_1=V_1'$$

$$V_2=V_2'$$

Specifically, when $T_C$ is a positive value, the recording paper 53 is pushed into the fuser roller 12. For example, when the weighting capacity is small, the recording paper 53 may deflect and be pressed, and the rotational speed of the fuser roller 12 does not change. When $T_C$ is a negative value, the recording paper 53 is pulled by the fuser roller 12, and the secondary roller 18 is pulled by the fuser roller 12. For example, when the pulling force is small, the rotational speed of the secondary roller 18 does not change.

When the torque $T_C$ is generated, the following Formulas 7 and 8 may be established.

$$T_A' \neq T_A - T_C \quad \text{Formula 7}$$

$$T_B' \neq T_B + T_C \quad \text{Formula 8}$$

By the exchange of the torque via the recording paper 53, the rotational speed of the secondary roller 18 or the fuser roller 12 changes. For example, when the torque $T_C$ is positive, the rotational speed $V_1$ of the secondary roller 18 is higher than the rotational speed $V_2$ of the fuser roller 12. Therefore, the rotational speed $V_2'$ of the fuser roller 12 is increased. When the torque $T_C$ is negative, the rotational speed $V_2$ of the fuser roller 12 is higher than the rotational speed $V_1$ of the secondary roller 18. Therefore, the rotational speed $V_1'$ of the secondary roller 18 is increased.

$$V_1 \neq V_1' \quad \text{Formula 9}$$

$$V_2 \neq V_2' \quad \text{Formula 10}$$

Therefore, if the torque $T_C$ is null, when Formulas 3 and 4 are established and before Formulas 7 and 8 are established, there is no exchange of the torque $T_C$ between the two rollers. The image forming apparatus 100 controls the rotational speed of the fuser roller 12 so as to make the torque $T_C$ be null.

Immediately after the recording paper 53 passes through the secondary roller 18, only the fuser roller 12 carries the recording paper 43. Provided that Formulas 3 and 4 are established, since the image forming apparatus 100 of Embodiment 1 makes the torque $T_C$ null, there is no effect whether Formulas 3 and 4 are established in realizing the image forming apparatus 100 of Embodiment 1.

Immediately after the recording paper passes through the secondary roller 18, the torque $T_C$ generated via the recording paper does not act on the secondary roller 18 and the fuser roller 12. Therefore, the rotational speed $V_1$ of the secondary roller 18 and the rotational speed $V_2$ of the fuser roller 12 are expressed as in Formulas 11 and 12.

$$V_1'' = f\{T_A'/J_A\} \quad \text{Formula 11}$$

$$V_2'' = f\{T_B'/J_B\} \quad \text{Formula 12}$$

Following Formulas 13 and 14 are established from Formulas 3 and 4. Therefore, the speed variation occurs in the secondary roller 18 and the fuser roller 12.

$$T_A \neq T_A' \quad \text{Formula 13}$$

$$T_B \neq T_B' \quad \text{Formula 14}$$

Therefore, the speed variation occurs in the secondary roller 18 and the fuser roller 12.

$$V_1 \neq V_1''$$

$$V_2 \neq V_2''$$

However, if the torque $T_C$ is controlled to be null when the recording paper 53 bridges between the two rollers 12 and 18 as described above, the torque is not exchanged. Therefore, the speed variation can be prevented from occurring immediately after the recording paper 53 passes through the secondary roller 18.

(Structure of the Control Unit)

Figure 5:
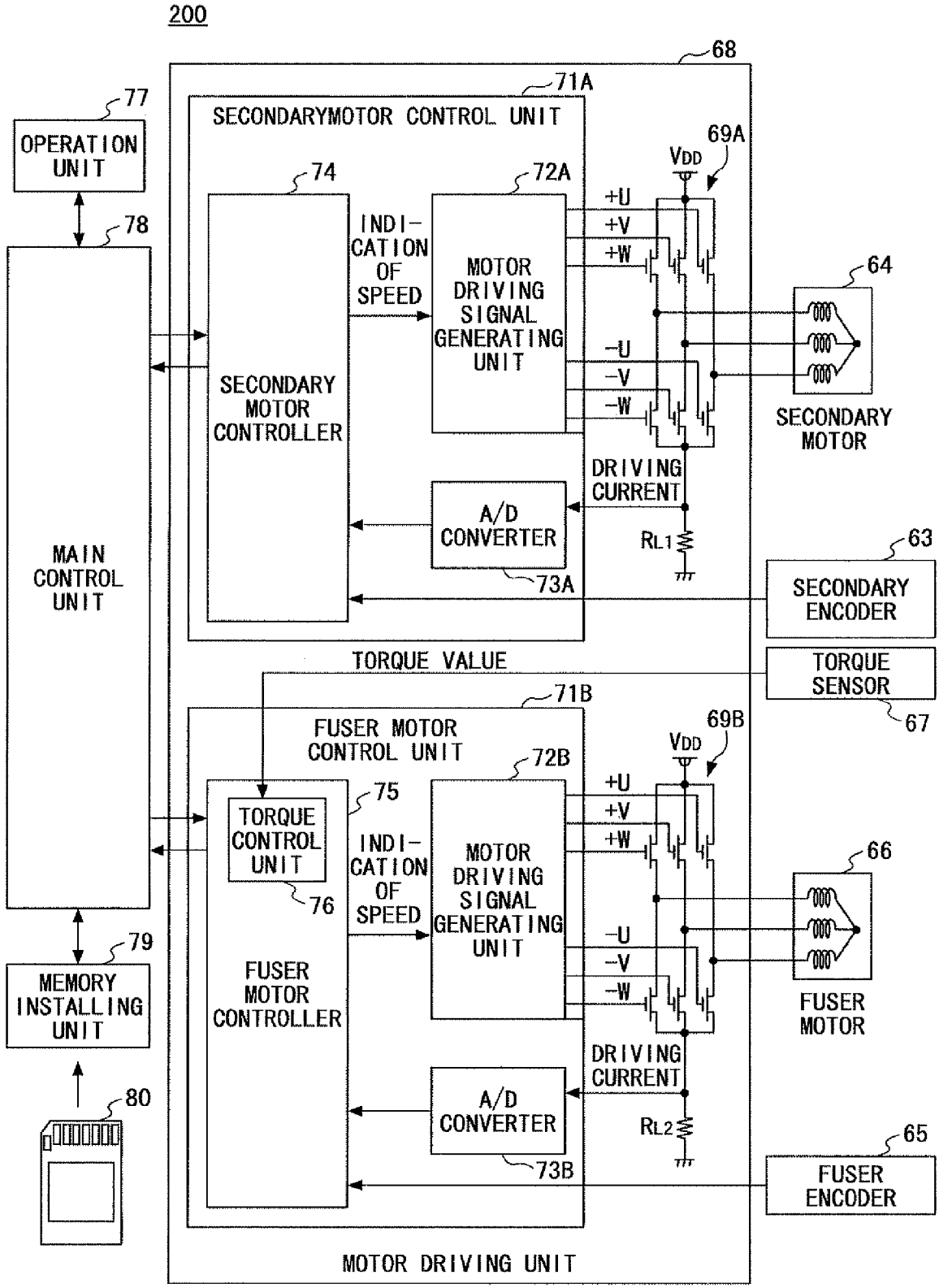
FIG. 5 is an example hardware block chart of a control device of the image forming apparatus.

FIG. 5 illustrates an example of a hardware block chart of the control device 200 of the image forming apparatus 100. The secondary motor control unit 71A and a fuser motor control unit 71B are connected to a motor driving circuit 68. The secondary motor control unit 71A includes a secondary motor controller 74, a motor driving signal generating unit 72A, and an A/D converter 73A. The fuser motor control unit 71B includes a fuser motor controller 75, a torque control unit 76, a motor driving signal generating unit 72B, and an A/D converter 73B. A secondary motor 64 is connected to the secondary motor control unit 71A via an inverter 69A. Further, a secondary transferring encoder 63 is connected to the secondary motor control unit 71A. The fuser motor 66 is connected to the fuser motor control unit 71B via an inverter 69B. Further, the fuser encoder 65 and the torque sensor 67 are connected to the fuser motor control unit 71B.

An operation unit 77 and a memory installing unit 79 are connected to the main control unit 78. The operation unit 77 may be a user interface enabling a menu display and selection from the menu display by integrally installing a liquid crystal display unit and a touch panel. Further, the operation unit 77 includes various hardware keys such as a selection key for switching a scanner function, a fax function, a copy function; a numerical keypad, a start key, a reset key, and an electric power switch. A recording medium 80 can be attached to and detached from the memory installing unit 79. A program is stored in the recording medium 80. The main control unit 78 reads the program via the memory installing unit 79 from the program in a HDD, a ROM or the like.

The main control unit 78, the secondary motor control unit 71A, and the fuser motor control unit 718 may be constituted by a computer or a microcomputer including a CPU, a DSP, a RAM, a ROM, an EEPROM, an input and output interface, a flash memory, and an application specific integrated circuit (ASIC). Computers or microcomputers constituting the secondary motor control unit 71A and the fuser motor control unit 71B may be separately provided. On the other hand, a computer or a microcomputer may have functions of the secondary motor control unit 71A and the fuser motor control unit 71B.

The secondary motor controller 74 and the fuser motor controller 75 may be realized by execution of a program with the computer, or by an IC such as a DSP and an ASIC. The secondary motor controller 74 designates the rotational speed and reports the designated rotational speed to the motor driving signal generating unit 72A. In Embodiment 1, the rotational speed of the secondary motor 64 may be constant. It is possible for the main control unit 78 to variably control the rotational speed by requesting the secondary motor controller 74 to reduce the rotational speed when a heavy recording paper 53 is printed.

The secondary motor controller 74 may compare a rotational speed detected by the secondary transferring encoder 63 with a target rotational speed (hereinafter referred to as "target speed"), and determine a speed to be indicated to a motor driving signal generating unit by calculating in conformity with a PI control. The target speed is determined such that the outer circumferential speed of the secondary roller 18 becomes the same as the surface speed of the intermediate transferring belt 14.

The motor driving signal generating units 72A and 72B are connected to the inverters 69A and 69B including six field effect transistors (FET). The motor driving signal generating unit 72A compares a constant voltage determined based on the indication of the speed with, for example, a triangular wave (carrier wave) having a predetermined frequency thereby determining a duty ratio of a PWM signal using a crossing point of these [FETs?]. The motor driving signal generating unit 72A generates the PWM signal having the duty ratio and outputs the PWM signal to the six FETs. The FETs repeat turning on or off with the PWM signal, and currents of a U phase, a V phase and a W phase corresponding to turning on or off are input in the secondary motor 64.

The A/D converter 73A converts a driving current flowing through a resistor RL1 from analog to digital and outputs the converted driving current to the secondary motor controller 74. The secondary motor controller 74 instructs the motor driving signal generating unit 72A to restrict the output of the PWM signal when the driving current is determined to be excessive by comparing the driving current with a reference value. In this way, it is possible to prevent the FETs forming the inverter 69A from being damaged.

The fuser motor 66 is controlled by the fuser motor controller 75 in a manner substantially the same as the control of the secondary motor 64. A characteristic of Embodiment 1 is that the torque sensor 67 is connected to the torque control unit 76 of the fuser motor controller 75.

Figure 6:
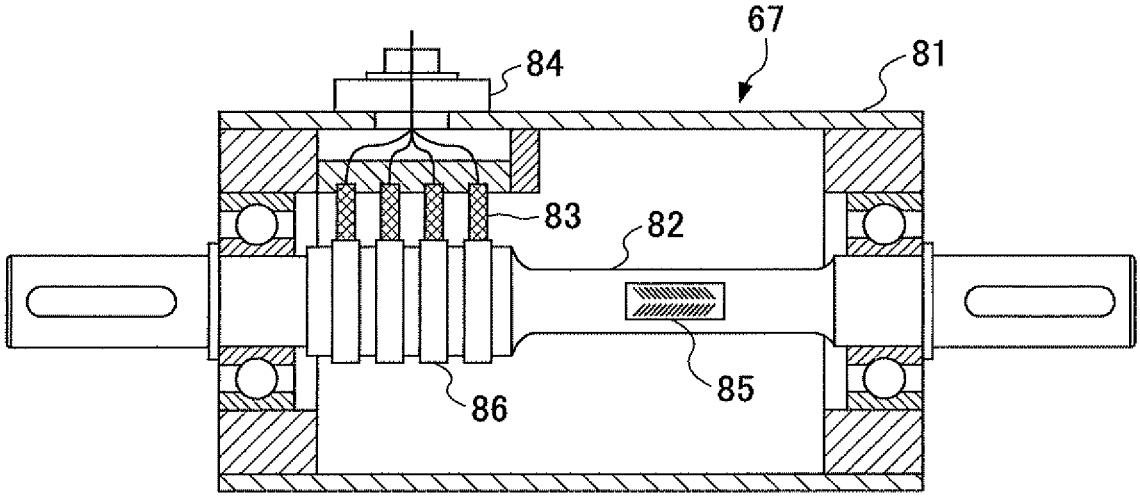
FIG. 6 illustrates an example torque sensor.

Referring to FIG. 6, the torque sensor 67 is described. Types of the torque sensor 67 are not specifically limited. Referring to FIG. 6, an example of the torque sensor 67 of a load cell plus a slip ring is illustrated. Besides, the torque sensor 67 of a phase difference type may be used.

A sensor shaft 82 of the torque sensor 67 rotating along with the secondary roller 18 is connected to the rotational shaft of the secondary roller 18. Load cells 85 are embedded in the sensor shaft 82. Slip rings 86 are provided around the entire periphery of the sensor shaft 82. The load cell 85 is a sensor which converts the magnitude of distortion to an electric signal.

The sensor shaft 82 is covered by a housing 81 via a bearing, and a detecting unit 84 is provided in the housing 81. The detecting unit 84 has brushes 83 in contact with the slip rings 86 with a biasing force to thereby be electrically connected to the slip rings 86. The brushes 83 slide on the surfaces of the slip rings 86 when the sensor shaft 82 rotates.

When a torque acts on the sensor shaft 82 to twist the sensor shaft 82, deformation of the load cells 85 is caused by twisting of the sensor shaft 82. After the load cells make at least one of a voltage and a current in response to the deformation, the detecting unit 84 detects the at least one of the voltage and the current via the slip rings 86 and the brushes 83. The detecting unit 84 converts the voltage or the current to a torque value of the secondary roller 18. The torque sensor 67 outputs analog or digital torque values to the fuser motor controller 75. In the former case, since the analog torque value is constantly input in the torque control unit 76, the torque control unit 76 acquires the analog torque value at every sampling period. In the latter case, since the digital torque value is periodically input in the torque control unit 76, the torque control unit 76 periodically acquires the digital torque value.

The fuser motor controller 75 may determine the speed to be indicated to the motor driving signal generating unit 72B by comparing the rotational speed detected by the fuser encoder 65 and the target speed detected by the fuser encoder 65 and calculating the result of the comparison based on a PI control. In Embodiment 1, the torque control unit 76 of the fuser motor controller 75 may calculate a correction value of the rotational speed of the fuser roller 12 from a comparison result between an average torque $T_{av}$ acting on the secondary roller 18 and a measured torque detected by the torque sensor 67. The fuser motor control unit 71B may correct the speed to be indicated to the motor driving signal generating unit 72B using the correction value. Examples of the measured torques are $T_A$ in FIG. 4A, $T_A'$ in FIG. 4B, and $T_A''$ in FIG. 4C.

Figure 7A:
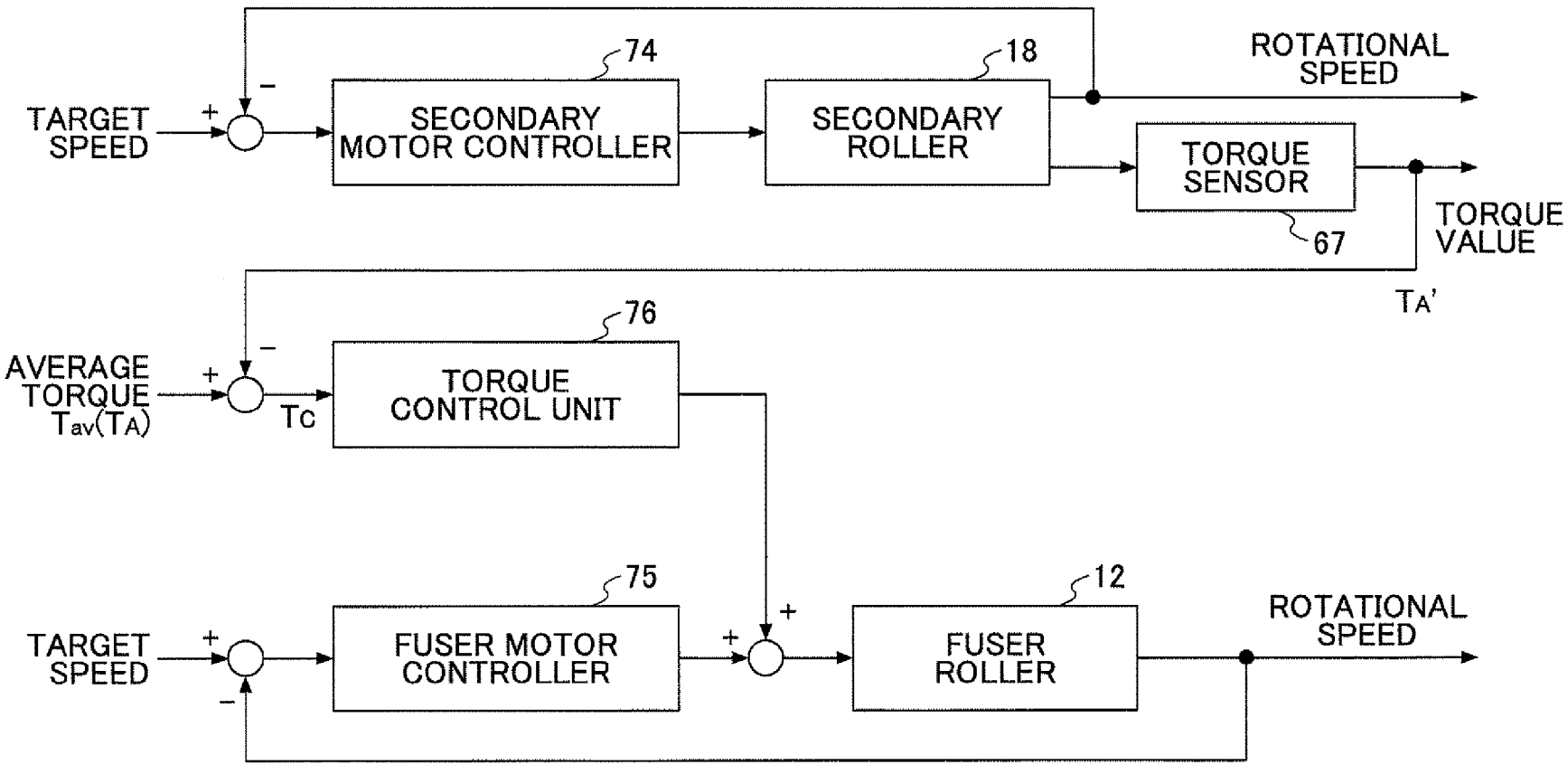
FIG. 7A is an example control block chart of a fuser motor.
Figure 7B:
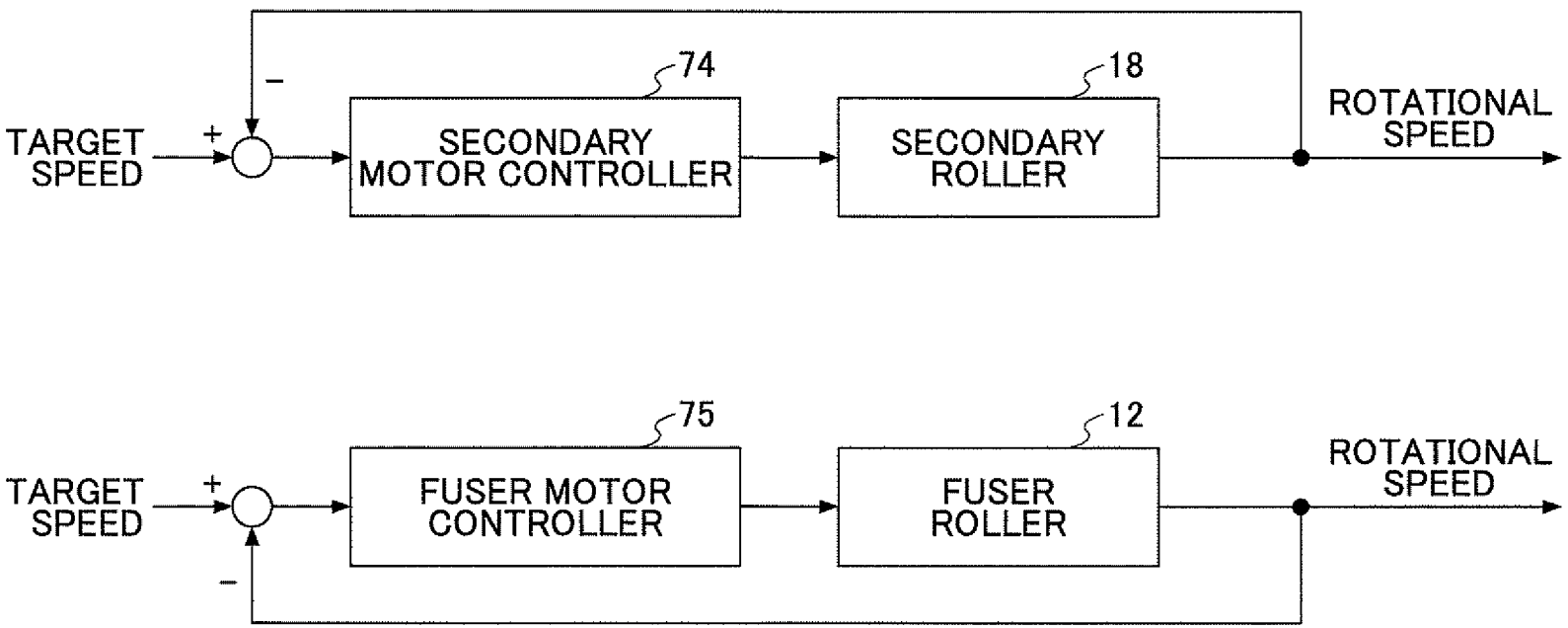
FIG. 7B is a comparative example control block chart of the fuser motor.

FIG. 7A illustrates an example of a control block chart of the fuser motor 66. FIG. 7B illustrates a comparative example of a control block chart of the fuser motor 66. Referring to FIG. 7B, rotational speeds of the fuser roller 12 and the secondary rollers 18 are separately subjected to feedback controls. The secondary motor controller 74 determines a control amount (indication of speed) by using a deviation (P) between the target speed and the rotational speed of the secondary roller 18, an integrated value (I) of the deviation, and gains for the deviation (P) and the integrated value (I). The fuser motor controller 75 determines a control amount (indication of speed) by using a deviation (P) between the target speed and the rotational speed of the fuser roller 12, an integrated value (I) of the deviation, and gains for the deviation (P) and the integrated value (I).

Referring to FIG. 7A, the rotational speed of the secondary roller 18 is controlled as in FIG. 7B. However, the rotational speed of the fuser motor 66 is subjected to a feedback control of the torque value. A torque deviation obtained by subtracting the measured torque $T_A'$ from the average torque $T_{av}$ is input in the torque control unit 76. The torque deviation corresponds to the above torque $T_C$, and the average torque $T_{av}$ corresponds to the torque $T_A$ illustrated in FIG. 4A. Hereinafter, the torque deviation is referred to as "torque deviation $T_C$". When the secondary roller 18 pushes the recording paper 53 toward the fuser roller 12, the secondary roller 18 receives the negative torque deviation $T_C$ acting back from the fuser roller 12. Therefore, the relationship of average torque $T_{av}<T_A$ is established. Meanwhile, when the fuser roller 12 pulls the recording paper 53 from the secondary roller 18, the secondary roller 18 receives the positive torque deviation $T_C$ acting from the fuser roller 12. Therefore, the relationship of average torque $T_{av}>T_A$ is established.

The average torque $T_{av}$ is an average value acting on the secondary roller 18 when only the secondary roller 18 carries the recording paper 53. The torque value is input by the torque sensor 67 to the torque control unit 76. The torque control unit 76 sets an average torque value during predetermined time as an average torque $T_{av}$. The reason why the torque control unit 76 calculates the average torque $T_{av}$ is to determine a torque deviation $T_C$ exchanged between the secondary roller 18 and the fuser roller 12. Therefore, the average torque $T_{av}$ is a torque value detected while the recording paper 53 starts to be carried by the secondary roller 18 and reaches the fuser roller 12. Therefore, the predetermined time used for calculating the average torque value is a period of time after the recording paper 53 passes the secondary roller 18 and reaches the fuser roller 12 at a maximum. This period of time may be previously determined by a distance between the secondary roller 18 and the fuser roller 12 and a carrying speed of the recording paper 53. The torque control unit 76 needs to obtain a sufficient number of torque values for calculating the average torque $T_{av}$ after the recording paper 53 passes the secondary roller 18. The minimum predetermined time for calculating the average torque $T_{av}$ is determined depending on a cycle time while the torque control unit 76 acquires the torque value from the torque sensor 67. In Embodiment 1, the predetermined time may be about 0.1 seconds.

The torque control unit 76 may determine a correction amount using the average torque $T_{av}$, the torque deviation $T_C$ of the measured torque $T_A$, an integrated value of the torque deviation $T_C$, and gains of the average torque $T_{av}$, the torque deviation $T_C$, and the integrated value of the torque deviation $T_C$. Since there is the above described relationship among the driving torque, the rotational inertia moment, and the rotational speed, the torque control unit 76 may estimate a rotational speed corresponding to the correction amount from the torque deviation $T_C$ and the rotational inertia moment $J_B$ of the fuser roller 12. Specifically, the rotational speed corresponding to the correction amount is experimentally adjusted to determine the gain. The torque control unit 76 converts the torque deviation $T_C$ between the average torque $T_{av}$ and the measured torque $T_A'$ to the correction amount of the rotational speed and outputs the converted correction amount to the fuser motor controller 75.

The fuser motor controller 75 subtracts the rotational speed of the fuser roller 12 at a present time from the target speed of the fuser roller 12 to obtain a speed deviation. The torque control unit 76 acquires the measured torque $T_A'$ acting on the secondary roller 18 at a time substantially the same as the present time from the torque sensor 67 and subtracts the acquired measured torque $T_A'$ from the average torque $T_{av}$ to calculate the torque deviation $T_C$. The fuser motor controller 75 calculates an operation amount of the rotational speed in response to the speed deviation. The torque control unit 76 calculates operation amounts corresponding to the correction amounts in response to the torque deviation. The fuser motor control unit 71B inputs the indication of speed obtained by adding two operation amounts to the motor driving signal generating unit 72B. With this control, the fuser motor control unit 71B makes the torque deviation null like $T_C=0$, namely $T_A=T_A'$ and $T_B=T_B'$ in Formulas 3 and 4.

(Operation Procedure)

Figure 8:
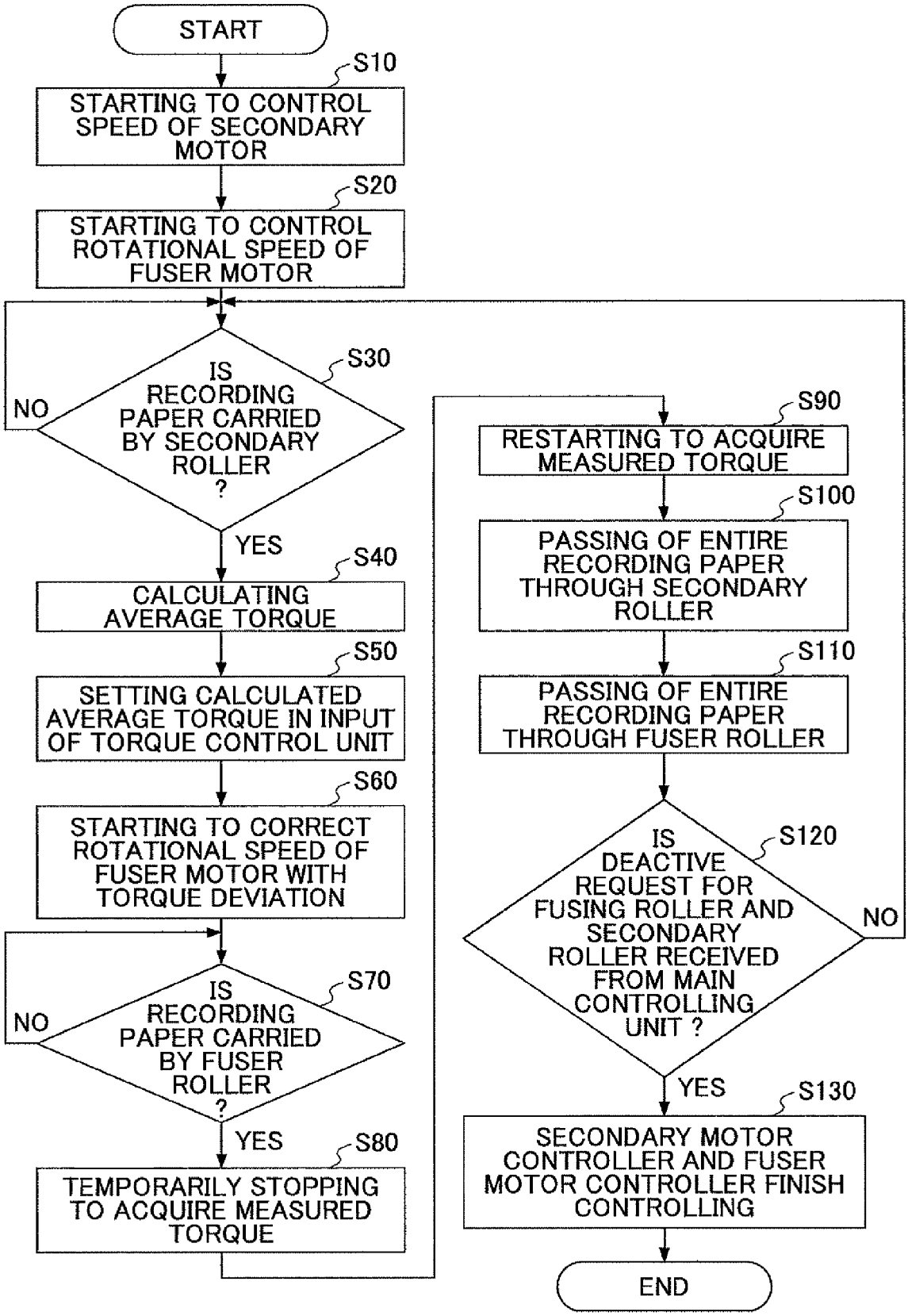
FIG. 8 is an example flowchart illustrating a procedure of controlling the rotational speed of a fuser roller with the image forming apparatus.

FIG. 8 is an example flowchart illustrating a procedure of controlling the rotational speed of the fuser roller 12 with the image forming apparatus 100 of Embodiment 1. The flowchart of FIG. 8 may start after the image forming apparatus prints on the recording paper 53.

The main control unit 78 sends a drive instruction to the secondary motor controller 74 and the fuser motor controller 75. The main control unit 78 may indicate the target speed. The target speed is indicated such that the outer circumferential speeds of the secondary motor 64 and the fuser motor 66 become the same.

Upon receipt of the drive instruction, the secondary motor controller starts to control speed of the secondary motor 64 in step S10.

Next, the fuser motor controller 75 starts to control the speed of the fuser motor 66 in step S20. The torque control unit 76 starts to acquire the torque values detected by the torque sensor 67.

Next, the torque control unit 76 determines whether the recording paper 53 comes into the secondary roller 18 to be carried by the secondary roller 18 in step S30. The following method may be considered to determine whether the recording paper 53 comes into the secondary roller 18.

(1) Monitoring the torque value detected by the torque sensor 67.

(2) Detecting whether the resist roller 33 starts to carry the recording paper 53.

(3) Monitoring a driving current flowing through the resistor RL1.

The torque value acting on the secondary roller 18 becomes large when the recording paper 53 is being carried in comparison with a case where the recording paper is not being carried. The torque control unit 76 monitors the torque value after the rotational speed of the secondary roller 18 is stabilized after the torque control unit 76 receives the drive instruction from the main control unit 78. The torque control unit 76 determines that the recording paper 53 comes into the secondary roller 18 when the variation (gradient) of the torque value is a predetermined amount or more.

The resist roller 33 restarts to carry the recording paper 53 after adjusting the timing so that the toner image on the intermediate transferring belt 14 is transferred onto the recording paper 53. The main control unit 78 detects that the resist roller 33 starts to carry the recording paper 53. Therefore, the torque control unit 76 is informed by the main control unit 78 that the resist roller 33 starts to carry the recording paper 53. Since the distance between the resist roller 33 and the secondary roller 18 and the carrying speed are known, the torque control unit 76 can determine that the recording paper 53 comes into the secondary roller 18 after passing a predetermined time after the report that the resist roller 33 starts to carry the recording paper 53. It is also possible to determine that the recording paper 53 comes into the secondary roller 18 when passing of the recording paper 53 is detected by a sensor near the secondary roller 18.

The driving current flowing through the resistor RL1 increases when a load on the secondary roller 18 increases. Therefore, the driving current flowing through the resistor RL1 increases when the recording paper 53 comes into the secondary roller 18. Ordinarily, the driving current is not detected by the torque control unit 76. The torque control unit 76 may acquire the driving current flowing through the resistor RL1 acquired by the secondary motor control unit 71A from the main control unit 78. The torque control unit 76 determines that the recording paper 53 comes into the secondary roller 18 when a variation (gradient) of the driving current is a predetermined amount or more. The torque control unit 76 may be informed by the secondary motor controller 74 that the recording paper 53 comes into the secondary roller 18.

Any one of the above methods (1) to (3) may be adopted. It is also possible to adopt all of the above methods (1) to (3) and determine that the recording paper 53 comes into the secondary roller 18 when determination by at least one of the methods (1) to (3) is obtained.

When the torque control unit 76 determines that the recording paper 53 comes into the secondary roller 18 in YES of step S30, the average torque $T_{av}$ is calculated from the measured torque $T_A$ detected by the torque sensor 67 in step S40. As described, the torque control unit 76 calculates an average of torque values for about 0.1 seconds after the recording paper comes into the secondary roller 18.

After the average torque $T_{av}$ is acquired, the torque control unit 76 sets the calculated average torque $T_{av}$ as an input to the torque control unit 76 in step S50.

The torque control unit 76 starts to correct the rotational speed of the fuser motor 66 by the torque deviation $T_C$ in step S60, The average torque $T_{av}$ and the measured torque $T_A$ are substantially the same level until the recording paper 53 comes into the fuser roller 12. Therefore, the torque deviation $T_C$ is null. Therefore, the correction of the rotational speed with the torque deviation Tc is not affected by the rotational speed of the fuser motor 66. Therefore, there is no problem even if the correction with the torque deviation $T_C$ is applied to the control of the rotational speed of the fuser motor 66 before the recording paper comes into the fuser roller 12. Next, the torque control unit 76 determines whether the recording paper 53 comes into the fuser roller 12 in step S70. The reason why this is determined is that the measured torque $T_A'$ immediately after the recording paper 53 comes into the fuser roller 12 to be carried by the fuser roller 12 is not used because the measured torque $T_A'$ is not stabilized immediately after the recording paper 53 comes into the fuser roller 12. An event in which the recording paper 53 comes into the fuser roller 12 may be detected by passing of a predetermined time after it is determined that the recording paper 53 comes into the secondary roller 18 in step S30, a sudden change of the driving current flowing through a resistor RL2, and a detection of the recording paper 53 with a predetermined sensor.

When the torque control unit 76 determines that the recording paper 53 comes into the secondary roller 18 in YES of step S70, the acquisition of the measured torque $T_A'$ by the torque sensor is temporarily interrupted in step S80. The torque control unit 76 may use the measured torque $T_A$ acquired until the determination in which the recording paper 53 comes into the fuser roller 12 as a dummy. Said differently, even when it is determined that the recording paper 53 comes into the fuser roller 12, the torque control unit 76 temporarily uses the measured torque before the recording paper 53 comes into the fuser roller 12. The expression of "temporarily interrupt" includes not using for the control even if the measured torques are acquired.

An unstable variation of the measured torque $T_A'$ caused when the recording paper comes into the fuser roller 12 stops in a short time. Therefore, a period of temporarily interrupting the acquisition of the measured torque $T_A'$ may be short such as 10 μsec to several hundred μsec.

Then, the torque control unit 76 restarts to acquire the measured torque $T_A'$ detected by the torque sensor 67 in step S90. Thereafter, the torque control unit 76 continues to calculate the correction amounts of the rotational speeds in response to the torque deviation $T_C$ obtained by subtracting the measured torque $T_A'$ from the average torque $T_{av}$. In this way, the rotational speed of the fuser motor 66 is controlled so that $T_C=0$ is established in Formulas (3) and (4).

After a certain time passes, the entire recording paper 53 passes through the secondary roller 18 in step S100. Further, the entire recording paper 53 passes through the fuser roller 12 in step S110. Before the entire recording paper 53 passes through the fuser roller 12 after the entire recording paper 53 passes through the secondary roller 18, the rotational speed of the fuser roller is corrected using the torque deviation $T_C$. Said differently, the fuser motor control unit 71B controls the rotational speed of the fuser motor 66 so that the torque deviation $T_C$ becomes null even though the recording paper passes through the secondary roller 18. However, since the entire recording paper 53 has already passed through the secondary roller 18, there is no large influence in transferring of the images in the secondary transferring unit 50 even if the rotational speed of the fuser motor 66 changes. Therefore, after the recording paper passes through the secondary roller 18, there is no problem even if the correction is applied to the control of the rotational speed of the fuser motor 66. As such, the correction of the rotational speed with the torque deviation $T_C$ can be continued from the step S60 while the plural recording papers 53 are being printed, and the rotational speed can be easily stabilized by the feedback control.

It is determined whether deactivate requests for stopping the fuser roller 12 and the secondary roller 18 are received from the main control unit 78 by the fuser motor control unit 71B and the secondary motor control unit 71A in step S120. The deactivate request output from the main control unit 78 means completion of printing on to the recording paper 53, jamming of a paper, or the like.

When the deactivate request of the fuser roller 12 and the secondary roller 18 is not received from the main control unit 78 in NO of step S120, the fuser motor control unit 71B and the secondary motor control unit 71A repeat processes from step S30. Said differently, the second sheet and later of the recording papers 53 are printed.

When the deactivate request of the fuser roller 12 and the secondary roller 18 is received from the main control unit 78 in YES of step S120, the fuser motor control unit 71B and the secondary motor control unit 71A stop the control in step S130. Thus, the fuser roller 12 and the secondary roller 18 stop.

As described, the image forming apparatus 100 of Embodiment 1 controls the rotational speed of the fuser motor 66 to make the torque deviation $T_C$ exchanged between the secondary roller 18 and the fuser roller 12 to be null to thereby prevent the pulling and the pushing of the recording paper 53. When a user prints the recording paper 53 having a great weighting capacity, the correction amount of the fuser roller 12 is automatically increased to thereby reduce the exchange of torque between the two rollers regardless of the value of weighting capacity. Therefore, it is possible to prevent image quality degradation and color shift caused by the exchange of the torque by restricting the exchange of the torque between the two rollers 18 and 12.

Although carrying of the recording paper 53 is exemplified, Embodiment 1 is also preferably applicable to a carrying apparatus for carrying a carried medium, such as a glass sheets and iron sheets, which is structured to bridge between two carrying rollers and a carrying method using the structure of the carrying apparatus.

Embodiment 2

In Embodiment 1, the torque acting on the secondary roller 18 is detected by the torque sensor 67, and the rotational speed of the fuser roller 12 is controlled to make the torque deviation $T_C$ exchanged between the secondary roller 18 and the fuser roller 12 null. In an image forming apparatus 100 of Embodiment 2, a torque acting on an intermediate roller 20 is detected by a torque sensor 67 to control the rotational speed of a fuser roller 12. A hardware block chart is substantially the same as FIG. 5 in Embodiment 1. Therefore, the hardware block chart is omitted.

Figure 9:
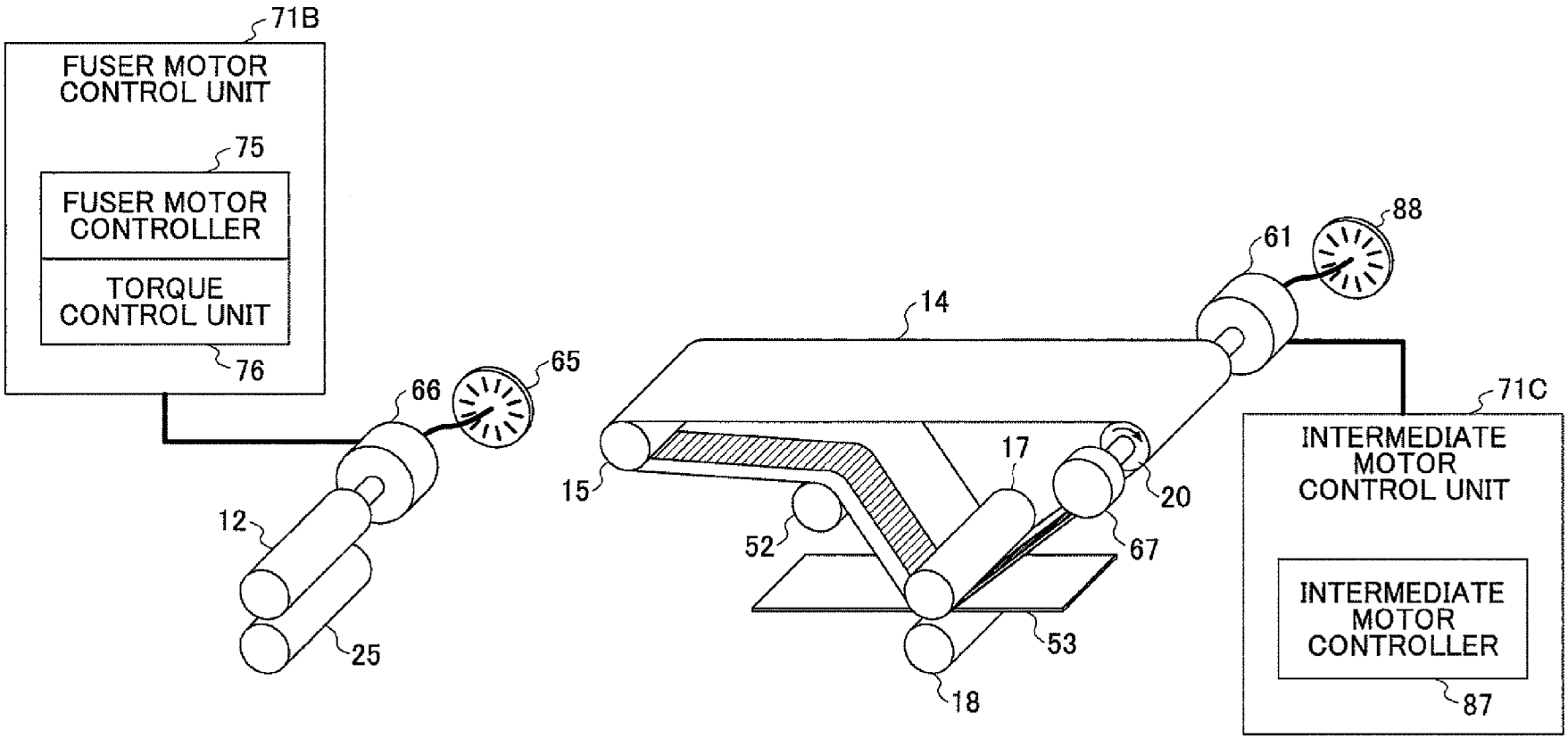
FIG. 9 illustrates schematic structures of an intermediate transferring belt and a fuser device.

FIG. 9 illustrates an example of schematic structures of the secondary transferring unit 14 and the fuser device 19. In FIG. 9, explanations which are the same as those of FIG. 2 are omitted. The intermediate roller 20 is rotated by a rotating force of the intermediate motor 61. An intermediate encoder 88 is provided in the intermediate motor 61 to detect the rotational speed of the intermediate roller 20. The intermediate encoder 88 detects the number of slits passing through the sensor per unit time, determines the rotational speed of the intermediate roller 20 based on the number, and outputs the determined rotational speed to an intermediate motor control unit 71C.

The secondary roller 18 and the intermediate roller 20 mutually act via the intermediate transferring belt 14. Therefore, when the recording paper 53 bridges between the secondary roller 18 and the fuser roller 12, and a torque deviation $T_C$ is exchanged between the two rollers 18 and 12, a torque substantially the same as the torque deviation $T_C$ is exchanged between the fuser roller 12 and the intermediate roller 20. Therefore, it is possible to acquire an effect similar to that in Embodiment 1 by detecting the torque acting on the intermediate roller 20 by the torque sensor 67 and controlling the rotational speed of the fuser roller 12 so that the torque deviation $T_C$ between an average torque $T_{av}$ and a torque acquired when the recording paper bridges between the secondary roller 18 and the fuser roller 12 becomes null.

Figure 10:
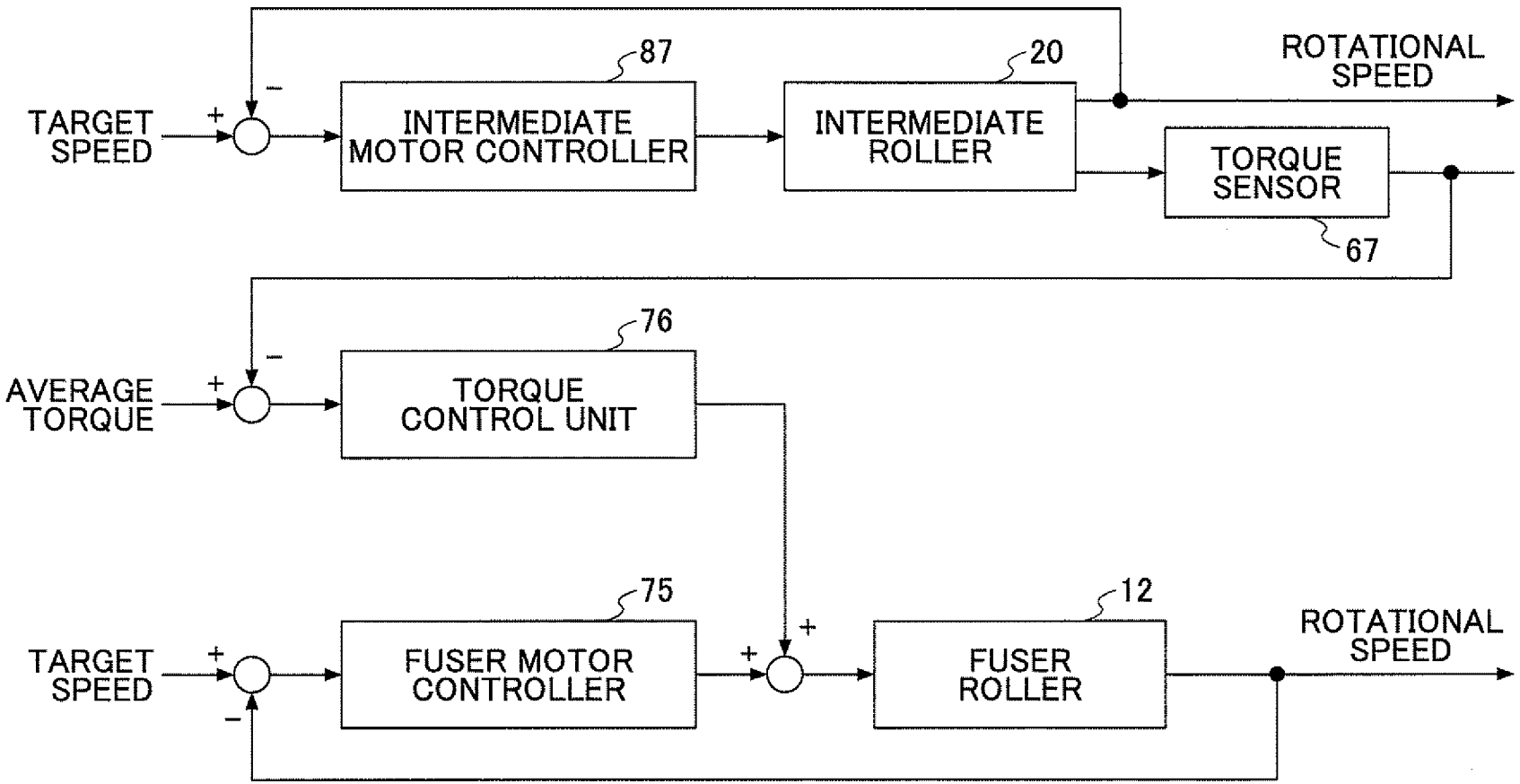
FIG. 10 is an example control block chart of the intermediate motor.

FIG. 10 is an example control block chart of the intermediate motor 61. Referring to FIG. 10, explanations the same as those of FIG. 7A are omitted. Referring to FIG. 10, an intermediate transferring motor controller 87 is provided instead of the secondary motor controller 74, and an intermediate roller 20 is provided instead of the secondary roller 18. The torque sensor 67 may be the torque sensor 67 in FIG. 7A. However, the torque sensor 67 may also be appropriately designed in consideration of a range of the torque acting on the intermediate roller 20.

The fuser motor controller 75 subtracts the rotational speed of the fuser roller 12 at a present time from the target speed of the fuser roller 12 to obtain a speed deviation. The torque control unit 76 acquires the measured torque $T_A'$ acting on the intermediate roller 20 at a time substantially the same as the present time from the torque sensor 67 and subtracts the acquired measured torque $T_A'$ from the average torque $T_{av}$ to calculate the torque deviation $T_C$. The fuser motor controller 75 calculates an operation amount of the rotational speed in response to the speed deviation. The torque control unit 76 calculates operation amounts corresponding to the correction amounts in response to the torque deviation $T_C$. The fuser motor control unit 71B inputs an indication of a speed obtained by adding two operation amounts to the motor driving signal generating unit 72B. With this control, the fuser motor control unit 71B can make the torque deviation $T_C$ null as $T_C=0$.

Figure 11:
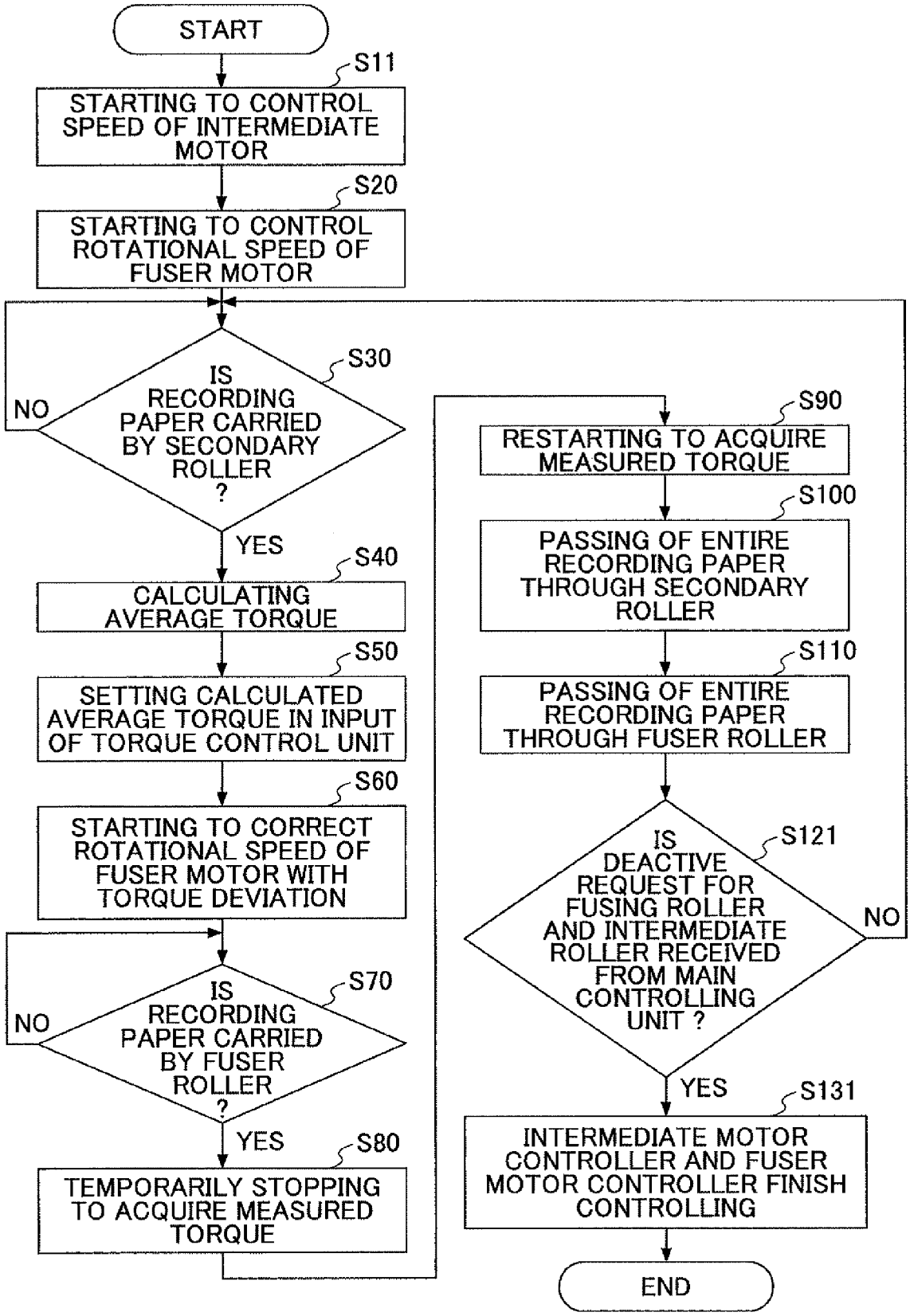
FIG. 11 is an example flowchart illustrating a procedure of controlling the rotational speed of the fuser roller with the image forming apparatus.

FIG. 11 is an example flowchart illustrating a procedure of controlling the rotational speed of the fuser roller 12 with the image forming apparatus 100 of Embodiment 2. Referring to FIG. 11, steps different from those in FIG. 8 are described.

The main control unit 78 sends a drive instruction to the intermediate motor controller 87 and the fuser motor controller 75. The main control unit 78 sends a drive instruction to the secondary motor controller 74.

Upon receipt of the drive instruction, the intermediate motor controller 87 starts to control the speed of the intermediate motor 61 in step S11.

Next, the fuser motor controller 75 starts to control the rotational speed of the fuser motor 66 in step S20. The torque control unit 76 starts to acquire the torque value detected by the torque sensor 67.

Next, the torque control unit 76 determines whether the recording paper 53 comes into the secondary roller 18 to be carried by the secondary roller 18 in step S30. The methods considered to determine whether the recording paper 53 comes into the secondary roller 18 are similar to those in Embodiment 1.

When the torque control unit 76 determines that the recording paper 53 comes into the secondary roller 18 in YES of step S30, an average torque $T_{av}$ is calculated from the torque value detected by the torque sensor 67 in step S40. As described, the torque control unit 76 calculates an average of torque values for about 0.1 seconds after the recording paper comes into the secondary roller 18.

After the average torque $T_{av}$ is acquired, the torque control unit 76 sets the calculated average torque $T_{av}$ as an input to the torque control unit 76 of FIG. 10 in step S50.

The torque control unit 76 starts to correct the rotational speed of the fuser motor 66 by the torque deviation $T_C$ in step S60. Next, the torque control unit 76 determines whether the recording paper 53 comes into the fuser roller 12 in step S70. When the torque control unit 76 determines that the recording paper 53 comes into the fuser roller 12 in YES of step S70, the acquisition of the measured torque $T_A'$ by the torque sensor 67 is temporarily interrupted in step S80. Then, the torque control unit 76 restarts to acquire the measured torque $T_A'$ detected by the torque sensor 67 in step S90. Thereafter, the torque control unit 76 continues to calculate the correction amounts of the rotational speeds in response to the torque deviation $T_C$ obtained by subtracting the measured torque $T_A'$ from the average torque $T_{av}$. In this way, the rotational speed of the fuser motor 66 is controlled so that $T_C=0$ is established in Formulas (3) and (4).

After a certain time passes, the entire recording paper 53 passes through the secondary roller 18 is step S100. Further, the entire recording paper 53 passes through the fuser roller 12 in step S110.

It is determined whether deactivate requests for stopping the fuser roller 12 and the intermediate roller 20 are received from the main control unit 78 by the fuser motor control unit 71B and the intermediate motor control unit 71C in step S121.

When the deactivate requests of the fuser roller 12 and the intermediate roller 20 are not received from the main control unit 78 in NO of step S121, the fuser motor control unit 71B and the intermediate motor control unit 71C repeat processes from step S30. Said differently, the second sheet and later of the recording papers 53 are printed.

When the deactivate request of the fuser roller 12 and the intermediate roller 20 is received from the main control unit 78 in YES of step S121, the fuser motor control unit 71B and the intermediate motor control unit 71C stop the control in step S131. Thus, the fuser roller 12 and the secondary roller 20 stop.

The image forming apparatus 100 of Embodiment 2 calculates the torque deviation $T_C$ exchanged between the secondary roller 18 and the fuser roller 12 from the torque acting on the intermediate roller 20, and the rotational speed of the fuser motor 66 is corrected so that the torque deviation $T_C$ becomes null. Therefore, it is possible to restrict image quality degradation and color shift caused by the exchange of the torque.

Embodiment 3

In Embodiment 1, the exchange of the torque deviation $T_C$ between the secondary roller 18 and the fuser roller 12 is on a downstream side of the secondary roller 18. The recording paper 53 may bridge between the secondary roller 18 and a roller on the upstream side such as the resist head such as a resist roller 33.

Figure 12:
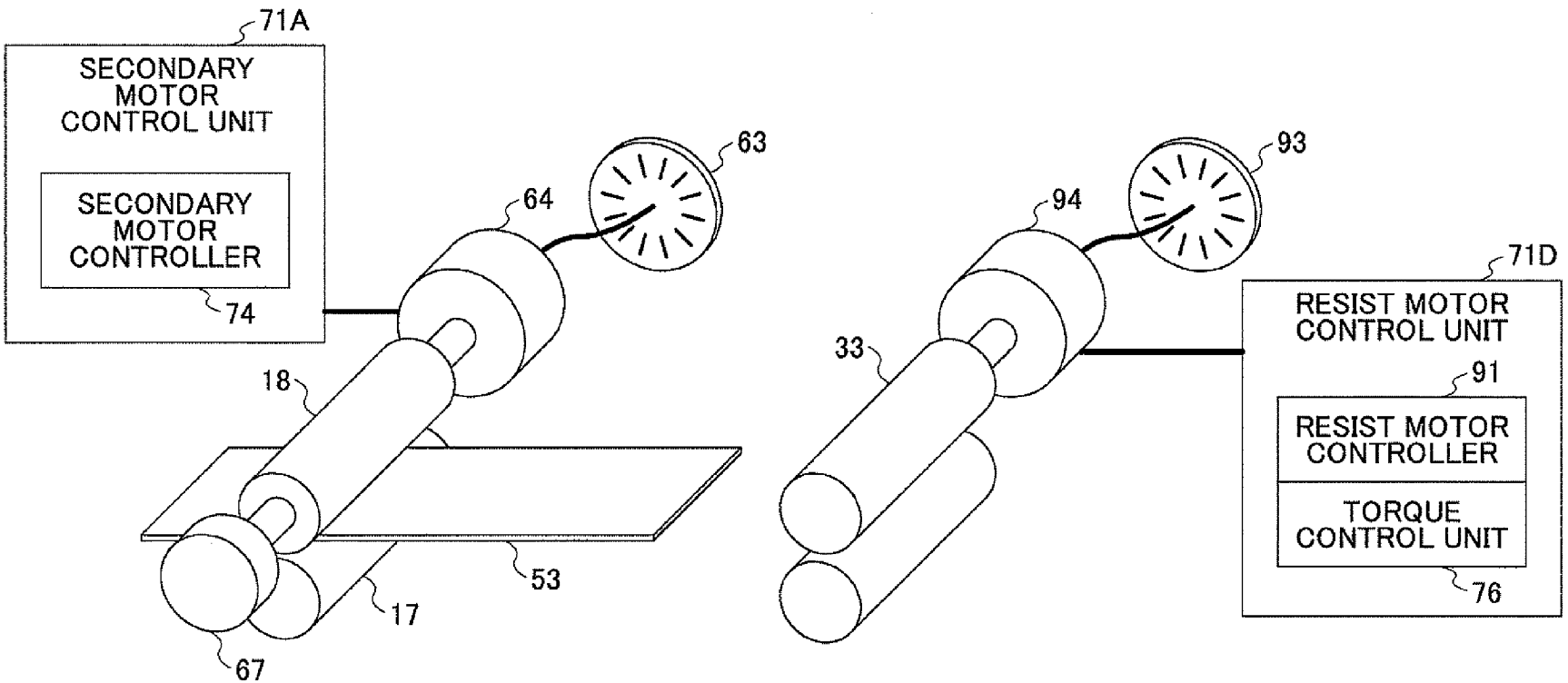
FIG. 12 illustrates schematic structures of the secondary transferring unit and a resist roller.

FIG. 12 illustrates an example of schematic structures of the secondary transferring unit 50 and the resist roller 33. In FIG. 12, explanations which are the same as those in FIG. 3 are omitted. When a recording paper 53 bridges between the resist roller 33 and the secondary roller 18, there may be caused an exchange of torque between the resist roller 33 and the secondary roller 18 by a difference of the rotational speeds or the outer circumferential speeds of the resist roller 33 and the secondary roller 18. In this case also, it is preferable to control the rotational speed of the resist roller 33 on the upper stream side by exchanging the torque. However, it is not preferable to control the rotational speed of the secondary roller 18 to make the exchange of the torque become null because the control of the rotational speed of the intermediate motor 61 or a timing of starting to carry the recording paper 53 is changed. However, the rotational speed of the secondary motor 64 may be controlled to null the exchange of torque in Embodiment 3.

Referring to FIG. 12, the resist roller 33 is rotated by a rotational force of the resist motor 94. The rotational shaft of the resist roller 33 is coaxial to the rotational shaft of the resist motor 94. The method of transmitting the rotational force is an example. A resist encoder 93 is provided on the resist motor 94 to detect the rotational speed of the resist roller 33. The resist encoder 93 detects the rotational speed of the resist motor 94 and the resist roller 33 using the number of slits passing through the sensor per unit time, and outputs the rotational speed to the resist motor control unit 71D.

Figure 13:
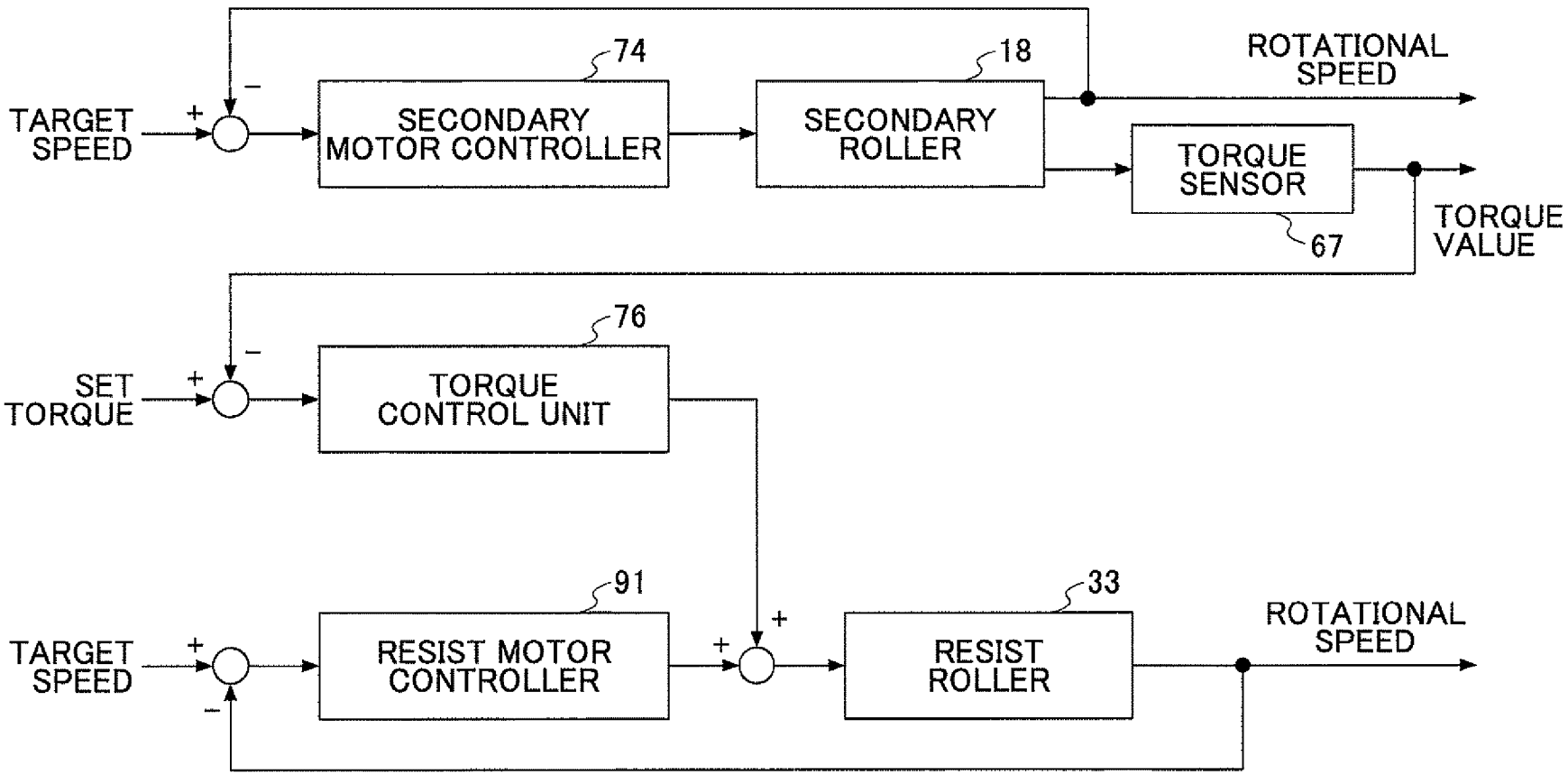
FIG. 13 is an example control block chart of the resist motor.

FIG. 13 is an example control block chart of the resist motor 94. Referring to FIG. 13, the same reference signs are attached to the same portions as those in FIG. 7A, and descriptions of these portions are omitted. Referring to FIG. 13, a set torque is input into the torque control unit 76 instead of the average torque in comparison with FIG. 7A. In Embodiment 4, the resist motor 94 is controlled instead of the fuser motor 66. Therefore, the resist motor controller 91 controls the resist roller 33 in a control block chart of FIG. 13.

When the resist motor control unit 71D controls the rotational speed of the resist roller 33 on an upstream side of the secondary roller 18 to null the torque deviation $T_C$, the recording paper 53 bridging occurs earlier than when only the secondary roller 18 carries the recording paper 53. The torque control unit 76 may not calculate an average torque $T_{av}$ acting on the secondary roller 18 at a time when only the secondary roller 18 carries the recording paper 53 when the recording paper 53 bridges between the resist roller 33 and the secondary roller 18. Therefore, the torque control unit 76 stores the set torque in an HDD, a ROM or the like using the following methods.

(i) When the entire recording paper passes through the resist roller 33 and only the secondary roller 18 carries the recording paper 53, the torque value detected by the torque sensor 67 is stored in the torque control unit 76 so as to be used when the recording paper 53 is printed next. The torque control unit 76 may store an average of the torque values of the past ten sheets for each of paper feeding trays 22*a* to 22*d* and makes the average to be the set torque. The same types of the recording papers 53 are frequently mounted on the corresponding paper feeding trays 22*a* to 22*d*, so the set torque may be stored for each weighting capacity. An event in which the entire recording paper 53 passes through the resist roller 33 may be detected after passing of a time determined by a paper size and a carrying speed of the recording paper 53 after the resist roller 33 starts to carry the recording paper 53.

(ii) Set torques which are empirically acquired are stored in an HDD, a ROM or the like. It is also possible that the torque control unit 76 detects humidity or temperature with a hygrometer or a thermometer to correct the stored average values. With this, it is possible to reduce influences of humidity and temperature effecting the torque value. The set torques may be acquired for each size of the recording papers 53.

The resist motor controller 91 subtracts the rotational speed of the resist roller 33 at the present time from the target speed of the resist roller 33 to obtain a speed deviation. The torque control unit 76 acquires the measured torque $T_A'$ acting on the secondary roller 18 at a time substantially the same as the present time from the torque sensor 67 and subtracts the acquired measured torque $T_A'$ from the set torque to calculate the torque deviation $T_C$. The resist motor controller 91 calculates an operation amount of the rotational speed in response to the speed deviation. The torque control unit 76 calculates operation amounts corresponding to the correction amounts in response to the torque deviation $T_C$. The resist motor control unit 71D inputs an indication of a speed obtained by adding two operation amounts to the motor driving signal generating unit (not illustrated). With this control, the resist motor control unit 71D can make the torque deviation $T_C$ null as $T_C=0$.

Figure 14:
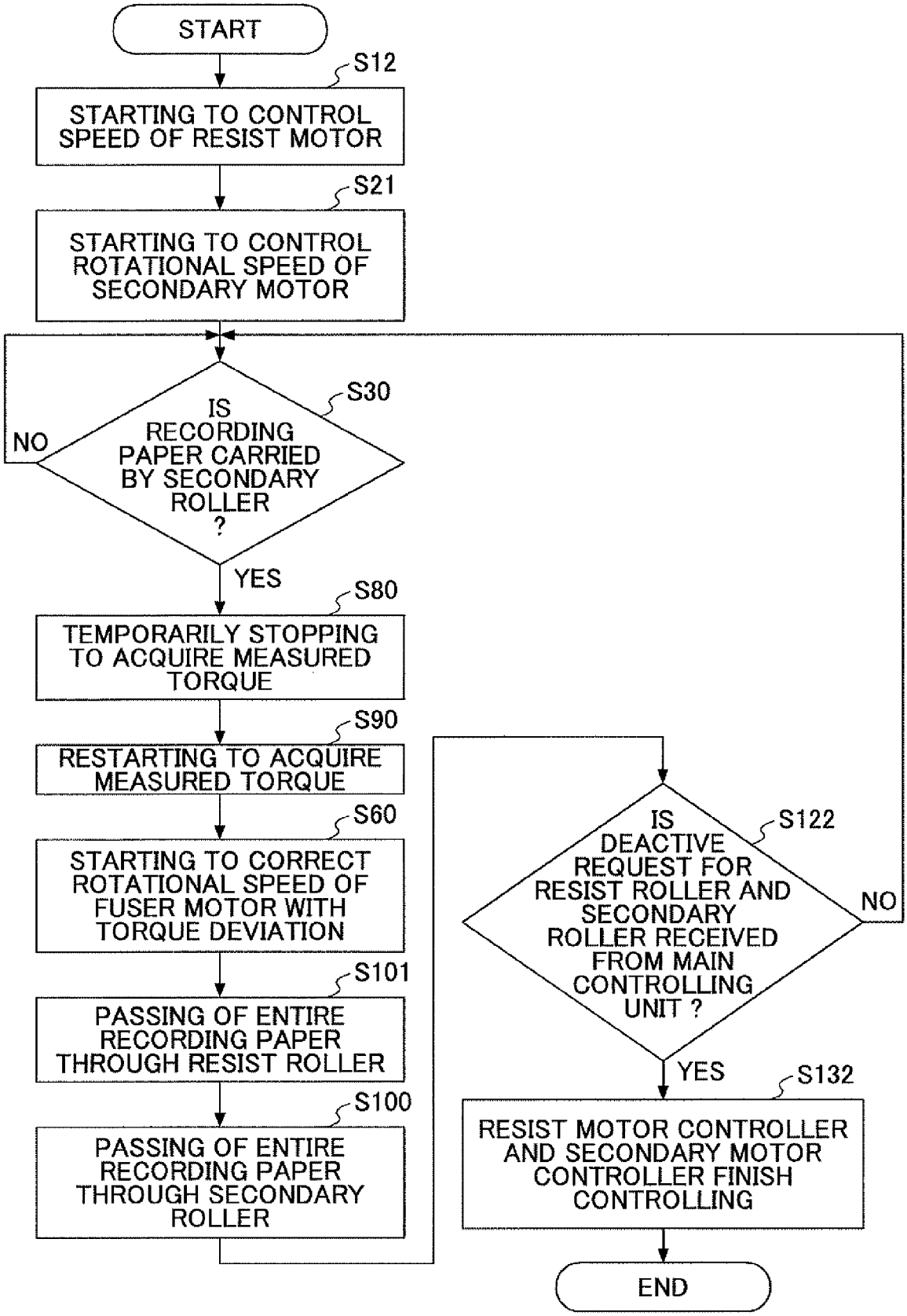
FIG. 14 is an example flowchart illustrating a procedure of controlling the rotational speed of the resist roller with the image forming apparatus.

FIG. 14 is an example flowchart illustrating a procedure of controlling the rotational speed of the resist roller 33 with the image forming apparatus 100. Referring to FIG. 14, the same reference symbols are used for steps the same as those in FIG. 8.

The main control unit 78 sends a drive instruction to the resist motor controller 91 and the secondary motor controller 74.

Upon receipt of the drive instruction, the resist motor controller 91 starts to control the speed of the intermediate motor 61 in step S12.

Next, the secondary motor controller 74 starts to control the rotational speed of the secondary motor 64 in step S21.

The torque control unit 76 starts to acquire the torque value detected by the torque sensor 67.

Next, the torque control unit 76 determines whether the recording paper 53 comes into the secondary roller 18 to be carried by the secondary roller 18 in step S30. The methods considered to determine whether the recording paper 53 comes into the secondary roller 18 are similar to those in Embodiment 1.

When the torque control unit 76 determines that the recording paper 53 comes into the secondary roller 18 in YES of step S30, the acquisition of the measured torque $T_A'$ by the torque sensor 67 is temporarily interrupted in step S80. Then, the torque control unit 76 restarts to acquire the measured torque $T_A'$ detected by the torque sensor 67 in step S90.

The torque control unit 76 starts to correct the rotational speed of the resist roller 33 with a torque deviation $T_C$ between the set torque and the measured torque in step S60. Thereafter, the torque control unit 76 continues to calculate the correction amounts of the rotational speeds in response to the torque deviation $T_C$ obtained by subtracting the measured torque $T_A'$ from the set torque. In this way, the rotational speed of the fuser motor 94 is controlled so that $T_C=0$ is established in Formulas (3) and (4).

After a certain time passes, the entire recording paper 53 passes through the resist roller 33 is step S101. Further, the entire recording paper 53 passes through the secondary roller 18 in step S100.

It is determined whether deactivate requests for stopping the secondary roller 18 and the resist roller 33 are received from the main control unit 78 by the secondary motor control unit 71A and the resist motor control unit 71D in step S122.

When the deactivate requests for the fuser roller 18 and the resist roller 33 are not received from the main control unit 78 in NO of step S122, the secondary motor control unit 71A and the resist motor control unit 71D repeat processes from step S30. Said differently, the second sheet and later of the recording papers 53 are printed.

When the deactivate requests for the resist roller 33 and the secondary roller 18 are not received from the main control unit 78 in YES of step S122, the secondary motor control unit 71A and the resist motor control unit 71D stops the control in step S132. Thus, the resist roller 33 and the secondary roller 18 stop.

The image forming apparatus 100 corrects the rotational speeds of the motor driving the roller on the upstream side of the secondary roller 18 to exchange torque between the secondary roller 18 and the roller positioned on the upstream side. Therefore, it is possible to prevent the recording paper 53 from pulling and pushing caused between the secondary roller 18 and the roller on the upstream side of the secondary roller 18.

The resist roller is merely an example of the roller holding the recording paper on the upstream side immediately before the secondary roller 18. Embodiment 3 is applicable to any other roller, for example, a timing control roller.

Embodiment 4

In Embodiments 1 to 3, the rotational speed of the fuser motor 66 or the resist motor 94 is controlled when the recording paper 53 bridges between the rollers to use the torque $T_A$ detected by the torque sensor 67 to make $T_C$ null like $T_C$=0.

However, it is known that there is a predetermined relationship between the driving current of a secondary motor and the torque of the secondary motor. Therefore, it is possible to control the rotational speed of the fuser roller 12 to avoid the torques from being exchanged between the fuser motor 66 and the secondary motor 64 when the recording papers 53 are bridging.

Figure 15:
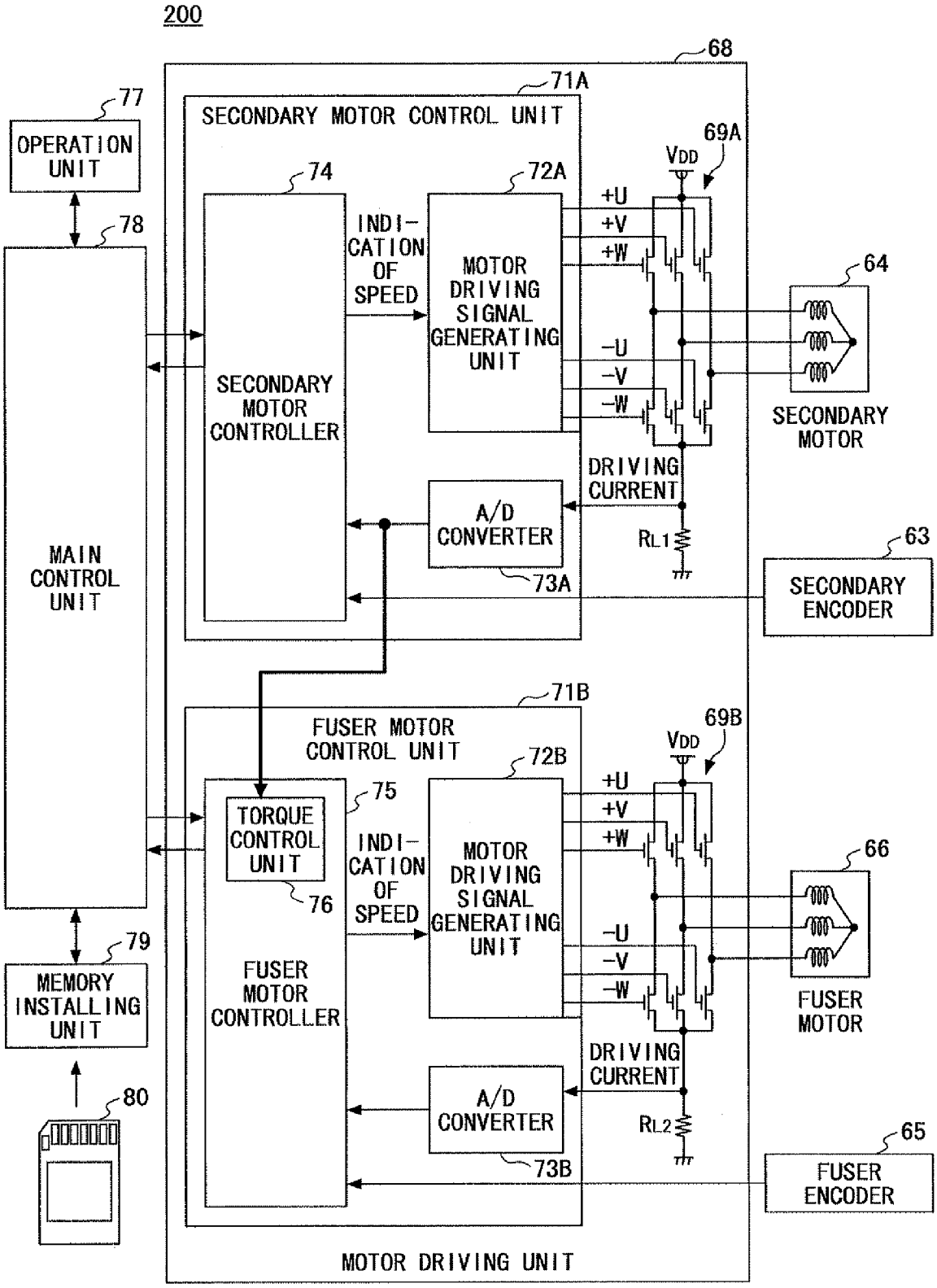
FIG. 15 is an example hardware block chart of the control device of the image forming apparatus.

FIG. 15 illustrates an example of a hardware block chart of the control device 200 of the image forming apparatus 100 of Embodiment 4. Referring to FIG. 15, the same reference signs are attached to the same portions as those in FIG. 5, and descriptions of these portions are omitted.

Referring to FIG. 15, there is no torque sensor 67. The output of the A/D converter 73A is connected not only to the secondary motor controller 74 but also to the torque control unit 76. Therefore, the value of the driving current flowing through a resistor RL1 is output to the torque control unit 76.

The torque control unit 76 converts the driving current to the torque as follows.

$$\text{Torque}=\text{Driving current}\times\text{Motor constant}$$

The torque is to control the rotational speed of the secondary motor 64. Therefore, the torque includes information which is the same as that of the torque $T_A$ and the torque $T_A'$. Therefore, it is possible to omit the torque sensor 67 by outputting the driving current to the torque control unit 76.

Figure 16:
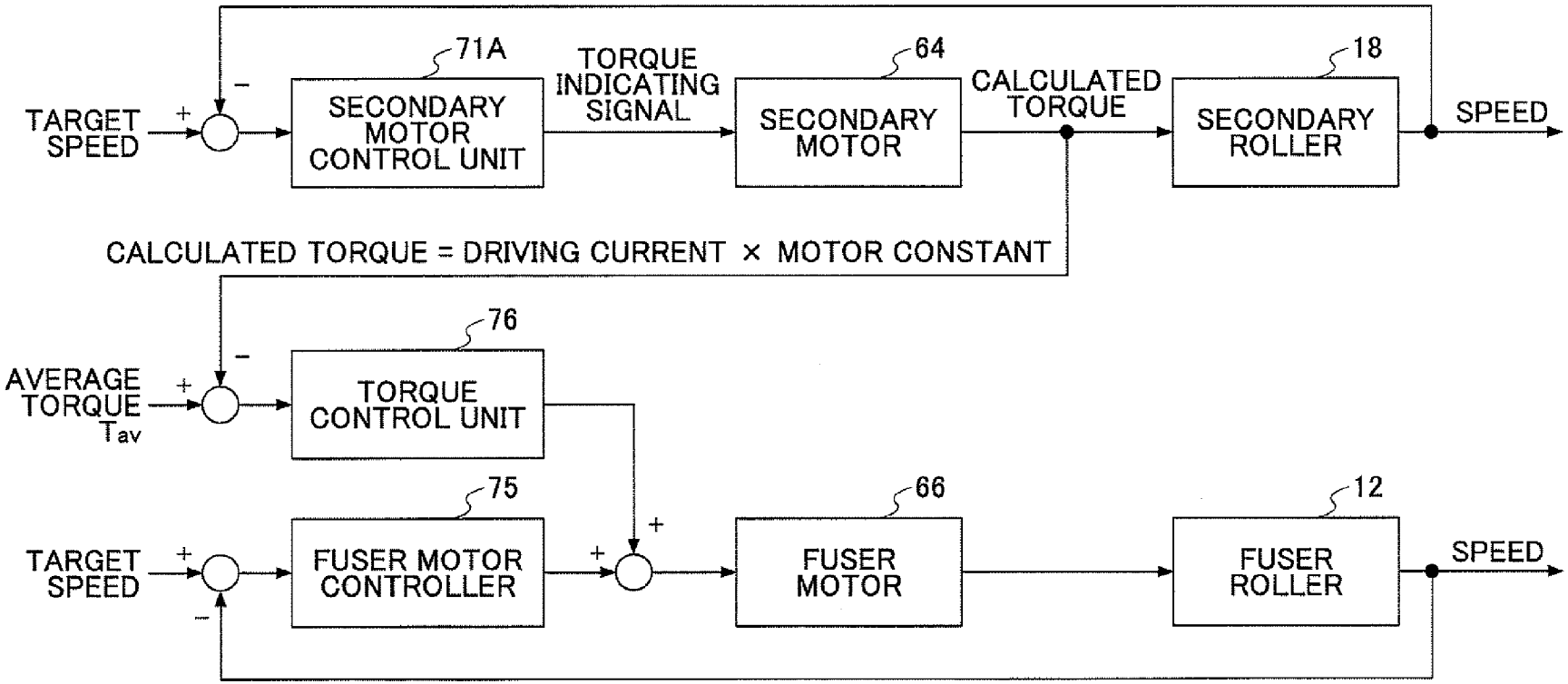
FIG. 16 is an example control block chart of the fuser motor.

FIG. 16 is an example control block chart of the fuser motor 66. Referring to FIG. 16, the same reference signs are attached to the same portions as those in FIG. 7A, and descriptions of these portions are omitted. Referring to FIG. 16, since there is no torque sensor 67 connected to the secondary roller 18 the torque is uniquely acquired from the driving current. Therefore, the detection of the driving current and the detection of the torques $T_A$ and $T_A'$ with the torque sensor 67 are similar because both of the detections acquire the information necessary for the controls. Specifically, the torque control unit 76 converts the driving current to the torque using the motor constant. Hereinafter, the torque obtained by converting from the driving current with the torque control unit 76 is a calculated torque.

As illustrated in Embodiment 1, when the secondary roller 18 pushes the recording paper 53 into the fuser roller 12, the torque $T_A'$ of the secondary roller 18 becomes larger than the average torque $T_{av}$. Therefore, when the secondary roller 18 pushes the recording roller 53 into the fuser roller 12, the driving current becomes larger than an average driving current in a case where the secondary roller 18 individually carries the recording paper 53. Therefore, if the driving current is input in a control system to which the torque $T_A'$ is input, a control similar to Embodiment 1 of nulling the torque deviation $T_C$ becomes possible.

(Operation Procedure)

Figure 17:
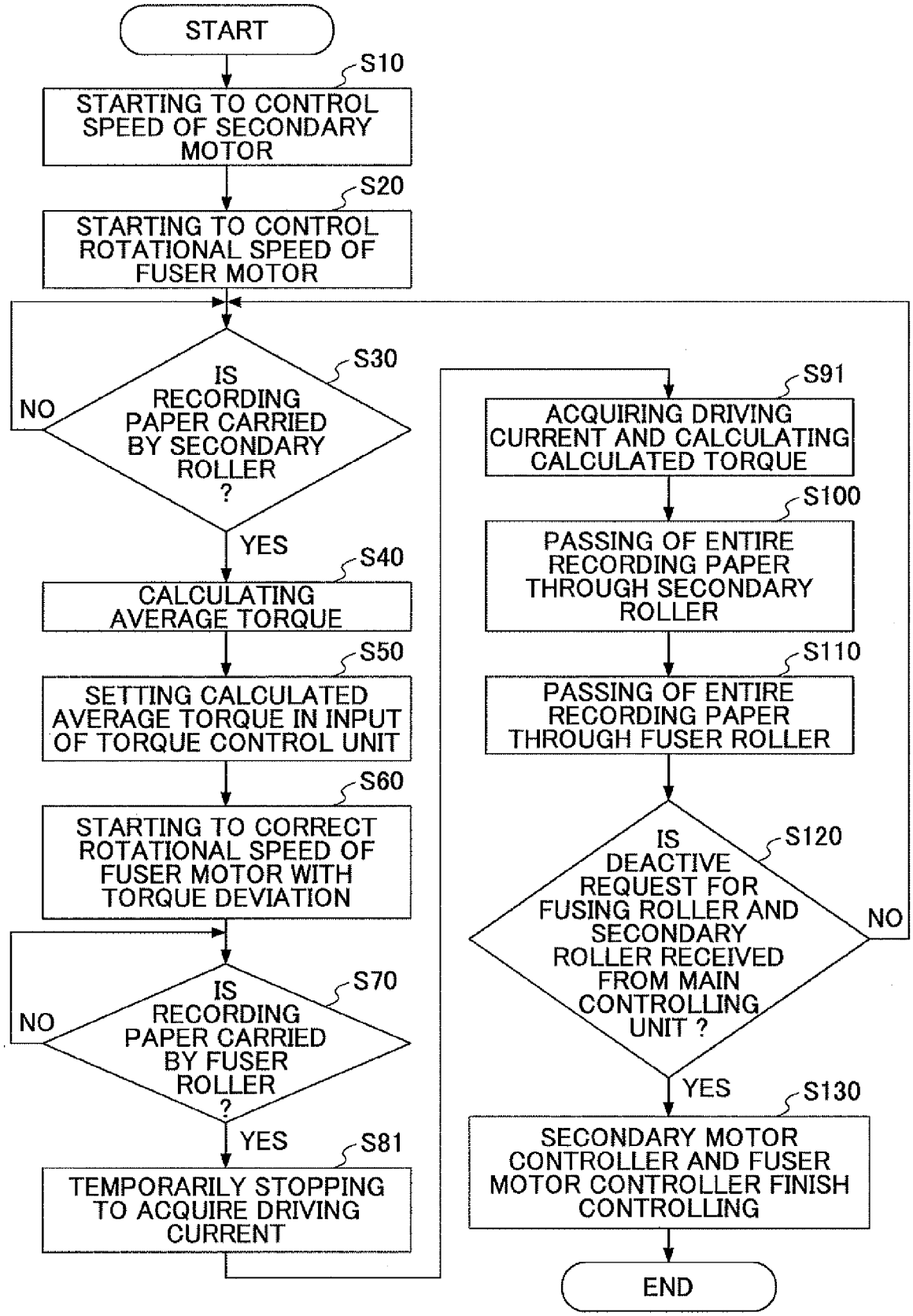
FIG. 17 is an example flowchart illustrating a procedure of controlling the rotational speed of the fuser roller with the image forming apparatus in Embodiment 4.

FIG. 17 is an example flowchart illustrating a procedure of controlling the rotational speed of the fuser roller 12 with the image forming apparatus 100 of Embodiment 4. The flowchart of FIG. 17 may start after the image forming apparatus 100 prints on the recording paper 53.

The main control unit 78 sends drive instructions to the secondary motor controller 74 and the fuser motor controller 75. The main control unit 78 may indicate the target speed. The target speed is indicated such that the outer circumferential speeds of the secondary motor 64 and the fuser motor 66 become the same. Upon receipt of the drive instruction, the secondary motor controller 74 starts to control the speed of the secondary motor 64 in step S10.

Next, the fuser motor controller 75 starts to control the speed of the fuser motor 66 in step S20. The torque control unit 76 starts to acquire the driving current via the A/D converter 73A, and calculates the calculated torque by multiplying the acquired driving current by the motor constant.

Next, the torque control unit 76 determines whether the recording paper 53 comes into the secondary roller 18 to be carried by the secondary roller 18 in step S30. The following method may be considered to determine whether the recording paper 53 comes into the secondary roller 18. The method is other than "(1) Monitoring the torque value detected by the torque sensor 67" in Embodiment 1, namely (2) and (3) in Embodiment 1.

When the torque control unit 76 determines that the recording paper 53 comes into the secondary roller 18 in YES of step S30, an average torque $T_{av}$ is calculated from the calculated torque in step S40. As described, the torque control unit 76 calculates an average of torque values for about 0.1 seconds after the recording paper 53 comes into the secondary roller 18.

After the average torque $T_{av}$ is acquired, the torque control unit 76 sets the calculated average torque $T_{av}$ as an input to the torque control unit 76 of FIG. 15 in step S50.

The torque control unit 76 starts to correct the rotational speed of the fuser motor 66 by the torque deviation $T_C$ in step S60. Since the average torque $T_{av}$ and the calculated torque $T_A$ are substantially the same until the recording paper 53 comes into the fuser roller 12, the torque deviation $T_C$ is substantially null. Therefore, the correction of the rotational speed with the torque deviation $T_C$ is not influenced by the rotational speed of the fuser motor 66. Therefore, there is no problem even if the correction with the torque deviation $T_C$ is applied to the control of the rotational speed of the fuser motor 66 before the recording paper 53 comes into the fuser roller 12.

Next, the torque control unit 76 determines whether the recording paper 53 comes into the fuser roller 12 in step S70. The reason why this is determined is that the measured torque $T_A'$ immediately after the recording paper 53 comes into the fuser roller 12 to be carried by the fuser roller 12 is not used because the measured torque $T_A'$ is not stabilized immediately after the recording paper 53 comes into the fuser roller 12. An event in which the recording paper 53 comes into the fuser roller 12 may be detected by passing of a predetermined time after it is determined that the recording paper 53 comes into the secondary roller 18 in step S30, a sudden change of the driving current flowing through a resistor RL2, or a detection of the recording paper 53 with a predetermined sensor.

When the torque control unit 76 determines that the recording paper 53 comes into the fuser roller 12 to be carried by the fuser roller 12 in YES of step S70, the acquisition of the driving torque $T_A'$ is temporarily interrupted in step S81. The torque control unit 76 may use the calculated torque calculated until the determination in which the recording paper 53 comes into the fuser roller 12 as a dummy for correcting the torque deviation $T_C$. Said differently, even when it is determined that the recording paper 53 comes into the fuser roller 12, the torque control unit 76 temporarily uses the calculated torque before the recording paper 53 comes into the fuser roller 12. The expression of "temporarily interrupt" includes not using the driving torque or the calculated torque for the control even if the measured torques are acquired.

An unstable variation of the driving current (calculated torque) caused when the recording paper 53 comes into the fuser roller 12 stops in a short time. Therefore, a period of temporarily interrupting the acquisition of the driving current may be short such as 10 μsec to several hundred μsec.

Next, the torque control unit 76 restarts acquiring the driving current and the calculated torque in step S91. Thereafter, the torque control unit 76 continues to calculate the correction amounts of the rotational speeds in response to the torque deviation $T_C$ obtained by subtracting the calculated torque $T_A'$ from the average torque $T_{av}$. In this way, the rotational speed of the fuser motor 66 is controlled so that $T_C=0$ is established in Formulas (3) and (4).

After a certain time passes, the entire recording paper 53 passes through the secondary roller 18 is step S100. Further, the entire recording paper 53 passes through the fuser roller 12 in step S110. Before the entire recording paper 53 passes through the fuser roller 12 and after the entire recording paper 53 passes through the secondary roller 18, the rotational speed of the fuser roller 12 is corrected using the torque deviation $T_C$. Said differently, the fuser motor control unit 71B controls the rotational speed of the fuser motor 66 so that the torque deviation $T_C$ becomes null even though the recording paper 53 passes through the secondary roller 18.

However, since the entire recording paper 53 has already passed through the secondary roller 18, there is no large influence in transferring of the images in the secondary transferring unit 50 even though the rotational speed of the fuser roller 12 changes. Therefore, after the recording paper passes through the secondary roller 18, there is no problem even if the correction is applied to the control of the rotational speed of the fuser motor 66. As such, the correction of the rotational speed with the torque deviation $T_C$ can be continued from the step S60 during the time plural recording papers 53 are printed, and the rotational speed can be easily stabilized by the feedback control.

It is determined whether deactivate requests for stopping the fuser roller 12 and the secondary roller 18 are received from the main control unit 78 by the fuser motor control unit 71B and the secondary motor control unit 71A in step S120. The deactivate request output from the main control unit 78 means completion of printing of the recording paper 53, jamming of a paper, or the like.

When the deactivate requests of the fuser roller 12 and the secondary roller 18 are not received from the main control unit 78 in NO of step S120, the fuser motor control unit 71B and the secondary motor control unit 71A repeat processes from step S30. Said differently, the second sheet and later of the recording papers 53 are printed.

When the deactivate requests of the fuser roller 12 and the secondary roller 18 are received from the main control unit 78 in YES of step S120, the fuser motor control unit 71B and the secondary motor control unit 71A stop the control in step S130. Thus, the fuser roller 12 and the secondary roller 18 stop.

As described, by detecting the driving current without using the torque sensor 67, the recording paper is prevented from being pulled or pushed in a manner similar to Embodiment 1.

Modified Example 1 of Embodiment 4

In Embodiment 4, the calculated torque is calculated from the driving current and used instead of the torque $T_A'$ of Embodiment 1. However, there is a proportional relationship between the driving current and the calculated torque. Therefore, a similar control is obtainable without converting to the calculated torque as a physical quantity.

Figure 18:
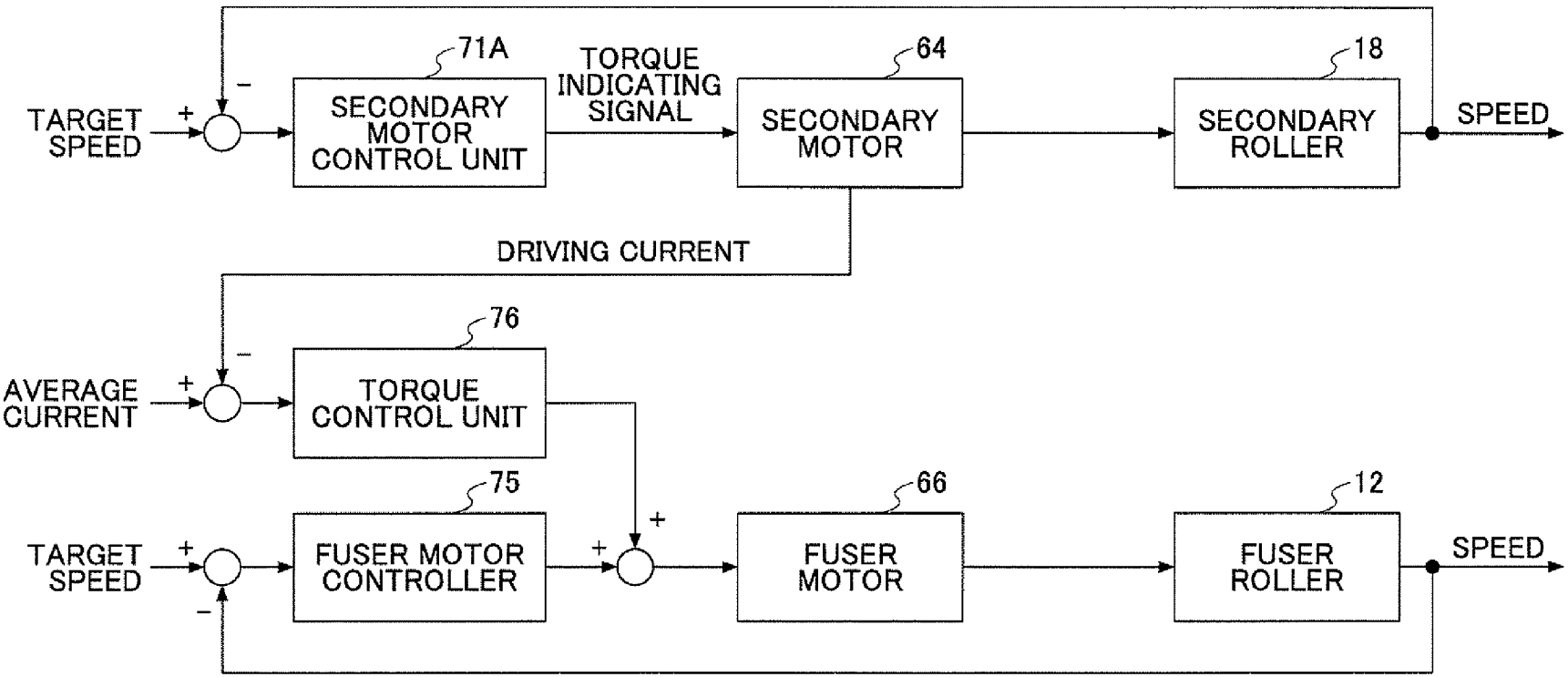
FIG. 18 is an example control block chart of the fuser motor.

FIG. 18 illustrates an example control block chart of a fuser motor 66 of Modified Example 1 of Embodiment 4. Referring to FIG. 18, the same reference signs are attached to the same portions as those in FIG. 16, and descriptions of these portions are omitted. Referring to FIG. 18, the average current and the driving current are input in the torque control unit 76. The average current is an average value of the driving current during the time the recording paper 53 is carried only by the secondary transferring roller 18 and reaches the fuser roller 12.

As described, the fuser motor controller 75 receives the drive instruction or the target rotational speed from the main control unit 78. Therefore, the target speed becomes a known value for the fuser motor controller 75. In Modified Example 1 of Embodiment 4, the torque deviation $T_C$ is acquired from the target torque and the calculated torque to thereby control the speed of the fuser roller 12. However, when the current deviation is acquired from the average current and the driving current and the speed of the fuser roller 12 is controlled, only a gain of the current deviation changes and the control of the fuser motor controller 75 does not change.

Therefore, by using the driving current and the average current instead of the calculated torque and the average current, the speed of the fuser roller 12 can be controlled by the fuser motor controller 75 so that torques are not exchanged.

Modified Example 2 of Embodiment 4

Figure 19:
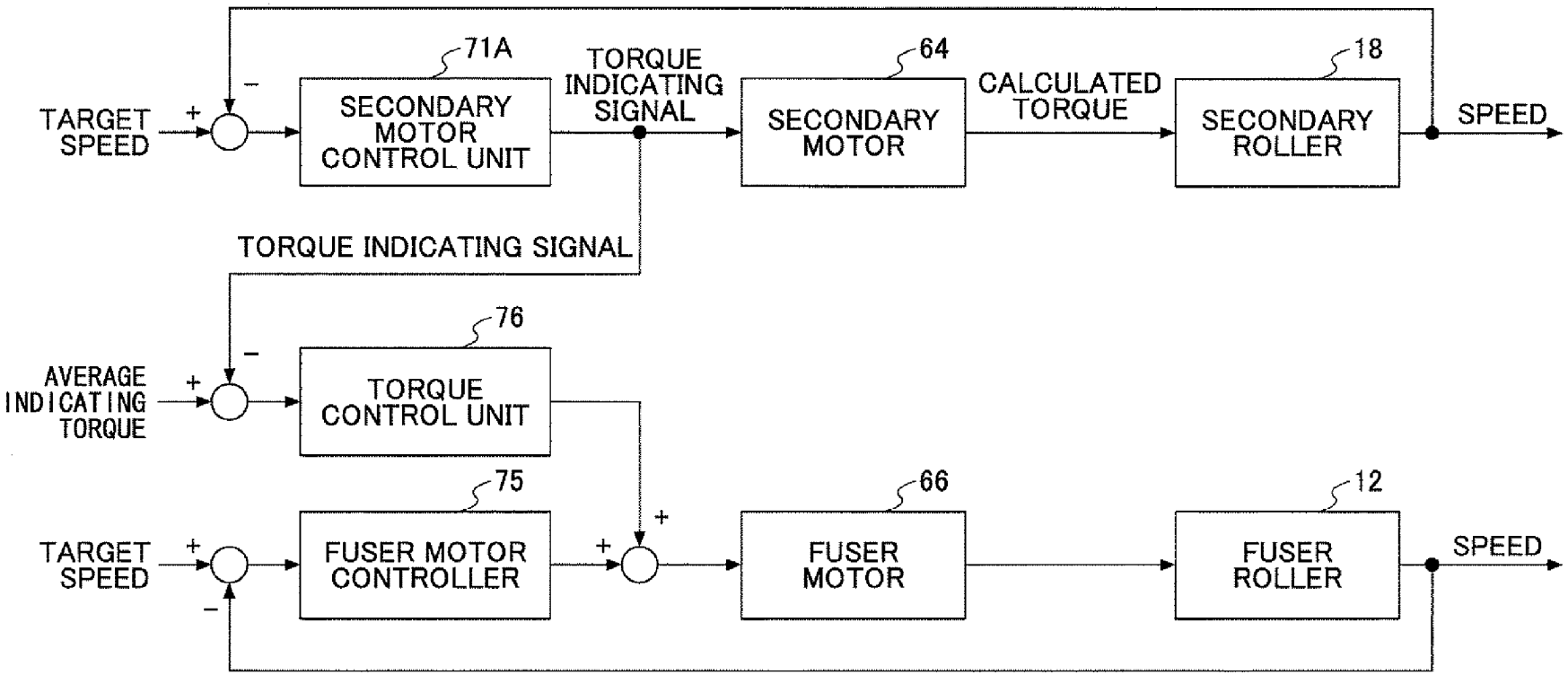
FIG. 19 is an example control block chart of the fuser motor.

FIG. 19 illustrates an example control block chart of a fuser motor 66 of Modified Example 2 of Embodiment 4. Referring to FIG. 19, the same reference signs are attached to the same portions as those in FIG. 16, and descriptions of these portions are omitted. Referring to FIG. 19, an average indicating torque and a torque indicating signal are input in the torque control unit 76.

The torque indicating signal is obtained by converting the speed to be indicated from the secondary motor controller 74 to the secondary motor 64 to a torque value with the secondary motor controller 74. The secondary motor controller 74 is directly connected to the fuser motor controller 75 or connected via the main control unit 78. The conversion of the indication of speed to the torque value may be done via the secondary motor controller 74 or the torque control unit 76. The average indicating torque is an average value of the torque indicating signal when only the secondary roller 18 carries the recording paper 53.

The torque indicating signal reflects the indication of speed which is subjected to feedback control based on the rotational speed of the secondary roller 18. When there is a sufficient exchange of torques between the secondary roller 18 and the fuser roller 12 to influence the speed, the torque indicating signal varies in response to the speed of the secondary roller 18. Therefore, when the recording paper 53 bridges between the secondary roller 18 and the fuser roller 12, there is a torque deviation $T_C$ between the average indicating torque and the torque indicating signal.

In a manner similar to Embodiment 1, when the pushing force acts on the fuser roller 12 from the secondary roller 18, a negative torque $T_C$ counteracts on the secondary roller 18 in the rightward direction. Therefore, the torque indicating signal becomes large in comparison with a case where only the secondary roller 18 carries the recording paper 53. On the contrary, when the fuser roller 12 pulls the recording paper 53 from the secondary roller 18, a positive torque $T_C$ counteracts on the secondary roller 18 in the leftward direction. Therefore, the torque indicating signal becomes small in comparison with a case where only the secondary roller 18 carries the recording paper 53. If the torque deviation $T_C$ is acquired from the calculated torque or the driving current, or from the torque indicating signal, these torques $T_C$ can be handled as similar values.

Therefore, in a similar manner to FIG. 16 and FIG. 18 of Embodiment 1 and Embodiment 4, by controlling the speed of the fuser roller 12 with the fuser motor controller 75 in response to the torque deviation $T_C$ between the average indicating torque and the torque indicating signal, it is possible to cancel the exchange of the torques between the secondary roller 18 and the fuser roller 12.

Figure 20:
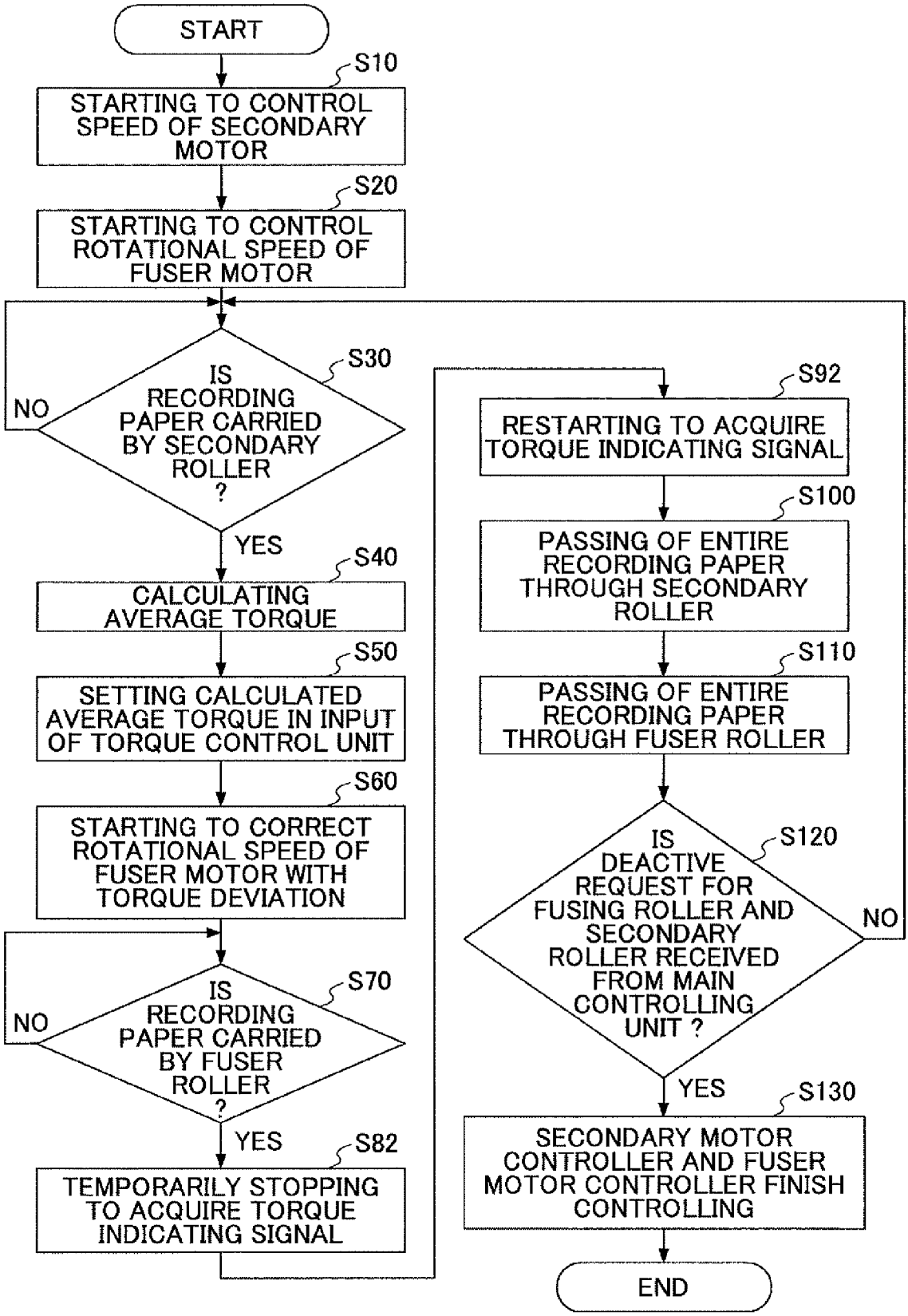
FIG. 20 is an example flowchart illustrating a procedure of controlling the rotational speed of the fuser roller with the image forming apparatus in a Modified Example of Embodiment 4.

FIG. 20 is an example flowchart illustrating a procedure of controlling the rotational speed of the fuser roller 12 with the image forming apparatus 100 illustrated in FIG. 18.

The main control unit 78 sends drive instructions to the secondary motor controller 74 and the fuser motor controller 75. The main control unit 78 may indicate the target speed. The target speed is indicated such that the outer circumferential speeds of the secondary motor 64 and the fuser motor 66 become the same.

Upon receipt of the drive instruction, the secondary motor controller 74 starts to control the speed of the secondary motor 64 in step S10.

Next, the fuser motor controller 75 starts to control the speed of the fuser motor 66 in step S20. The torque control unit 76 acquires the torque indicating signal from the target speed indicated for the secondary motor 64 by the secondary motor controller 64.

Next, the torque control unit 76 determines whether the recording paper 53 comes into the secondary roller 18 to be carried by the secondary roller 18 in step S30. The following method may be considered to determine whether the recording paper 53 comes into the secondary roller 18. The method is other than "(1) Monitoring the torque value detected by the torque sensor 67" in Embodiment 1, namely paragraphs (2) and (3) in Embodiment 1.

When the torque control unit 76 determines that the recording paper 53 comes into the secondary roller 18 in YES of step S30, the average indicating torque is calculated from the torque indicating signal in step S40. The torque control unit 76 calculates an average indicating torque obtained by averaging the torque indicating signals during about 0.1 seconds after the recording paper 53 comes into the secondary roller 18.

After the average torque $T_{av}$ is acquired, the torque control unit 76 sets the calculated average indicating torque as an input to the torque control unit 76 of FIG. 15 in step S50.

The torque control unit 76 starts to correct the rotational speed of the fuser motor 66 by using the torque deviation $T_C$ in step S60. Since the average indicating torque and the torque indicating signal are substantially the same level until the recording paper 53 comes into the fuser roller 12, the torque deviation $T_C$ is null. Therefore, the correction of the rotational speed with the torque deviation $T_C$ is not influenced by the rotational speed of the fuser motor 66. Therefore, there is no problem even if the correction with the torque deviation $T_C$ is applied to the control of the rotational speed of the fuser motor 66 before the recording paper 53 comes into the fuser roller 12.

Next, the torque control unit 76 determines whether the recording paper 53 comes into the fuser roller 12 in step S70. The reason why this is determined is that the torque indicating signal immediately after the recording paper 53 comes into the fuser roller 12 to be carried by the fuser roller 12 is not used for correcting the rotational speed of the fuser roller 12 because the torque indicating signal, immediately after the recording paper 53 comes into the fuser roller 12, is not stabilized. An event in which the recording paper 53 comes into the fuser roller 12 may be detected by passing of a predetermined time after it is determined that the recording paper 53 comes into the secondary roller 18 in step S30, or a detection of the recording paper 53 with a predetermined sensor.

When the torque control unit 76 determines that the recording paper 53 comes into the fuser roller 12 to be carried by the fuser roller 12 in YES of step S70, the acquisition of the torque indicating signal is temporarily interrupted in step S82. The torque control unit 76 may use the torque indicating signal acquired until the determination in which the recording paper 53 comes into the fuser roller 12 as a dummy for correcting the torque deviation $T_C$. Said differently, even when it is determined that the recording paper 53 comes into the fuser roller 12, the torque control unit 76 temporarily uses the torque indication before the recording paper 53 comes into the fuser roller 12. The expression of "acquisition . . . is temporarily interrupted" includes non-use of the torque indicating signal in the control even if the torque indicating signal is acquired.

An unstable variation of the driving current (calculated torque) caused when the recording paper 53 comes into the fuser roller 12 stops in a short time. Therefore, a period of temporarily interrupting the acquisition of the torque indicating signal may be short such as 10 μsec to several hundred μsec.

Next, the torque control unit 76 restarts the acquisition of the torque indicating signal in step S92. Thereafter, the torque control unit 76 continues to calculate the correction amounts of the rotational speeds in response to the torque deviations $T_C$ obtained by subtracting the torque indicating signal from the average indicating torque. In this way, the rotational speed of the fuser motor 66 is controlled so that $T_C=0$ is established in Formulas (3) and (4). The following process is the same as that in FIG. 17, therefore a description of the following process is omitted.

As described, by detecting the torque indicating signal without using the torque sensor 67, the recording paper is prevented from being pulled or pushed in a manner similar to Embodiment 1.

Embodiment 5

In Embodiment 5, the torque sensor 67 provided in the intermediate roller 20 in Embodiment 4 may be omitted.

Figure 21A:
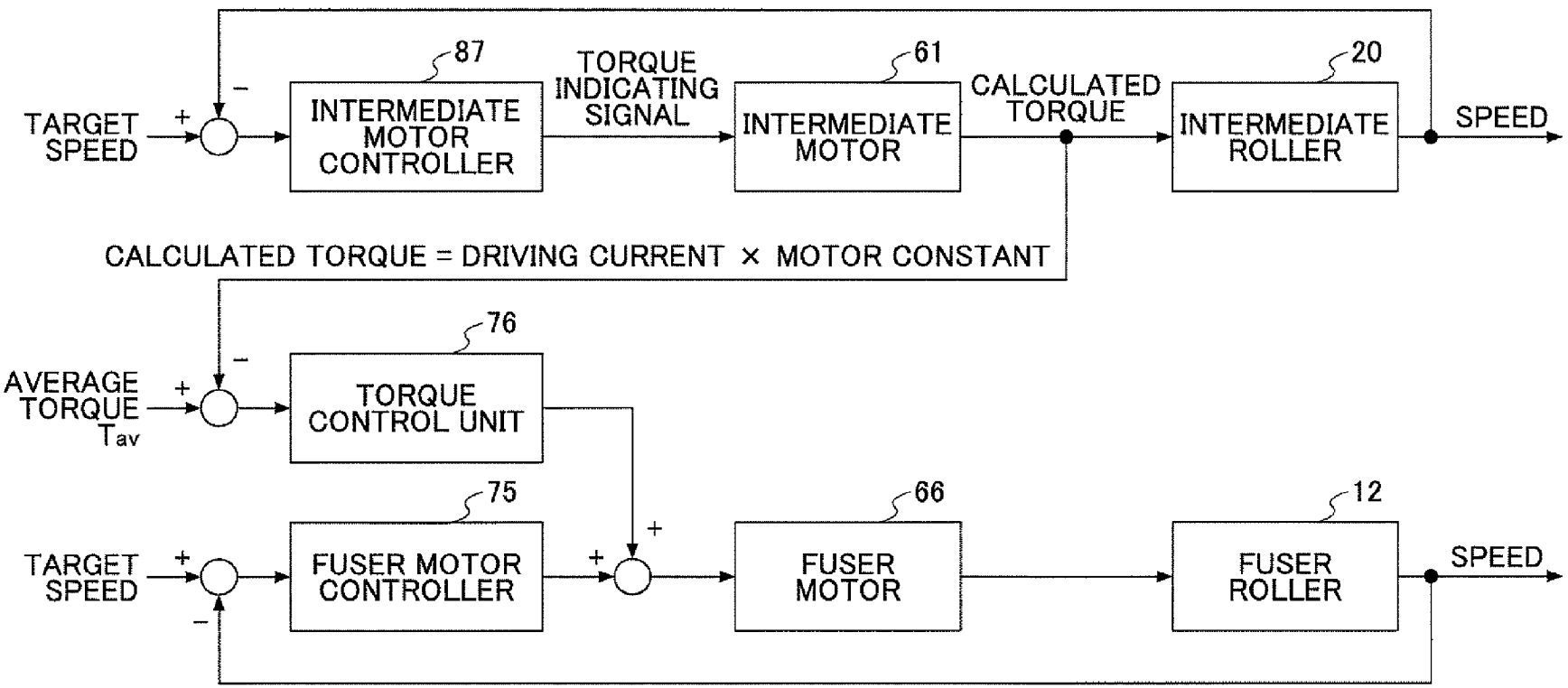
FIG. 21A is an example control block chart of the control device of the image forming apparatus of Embodiment 5.
Figure 21B:
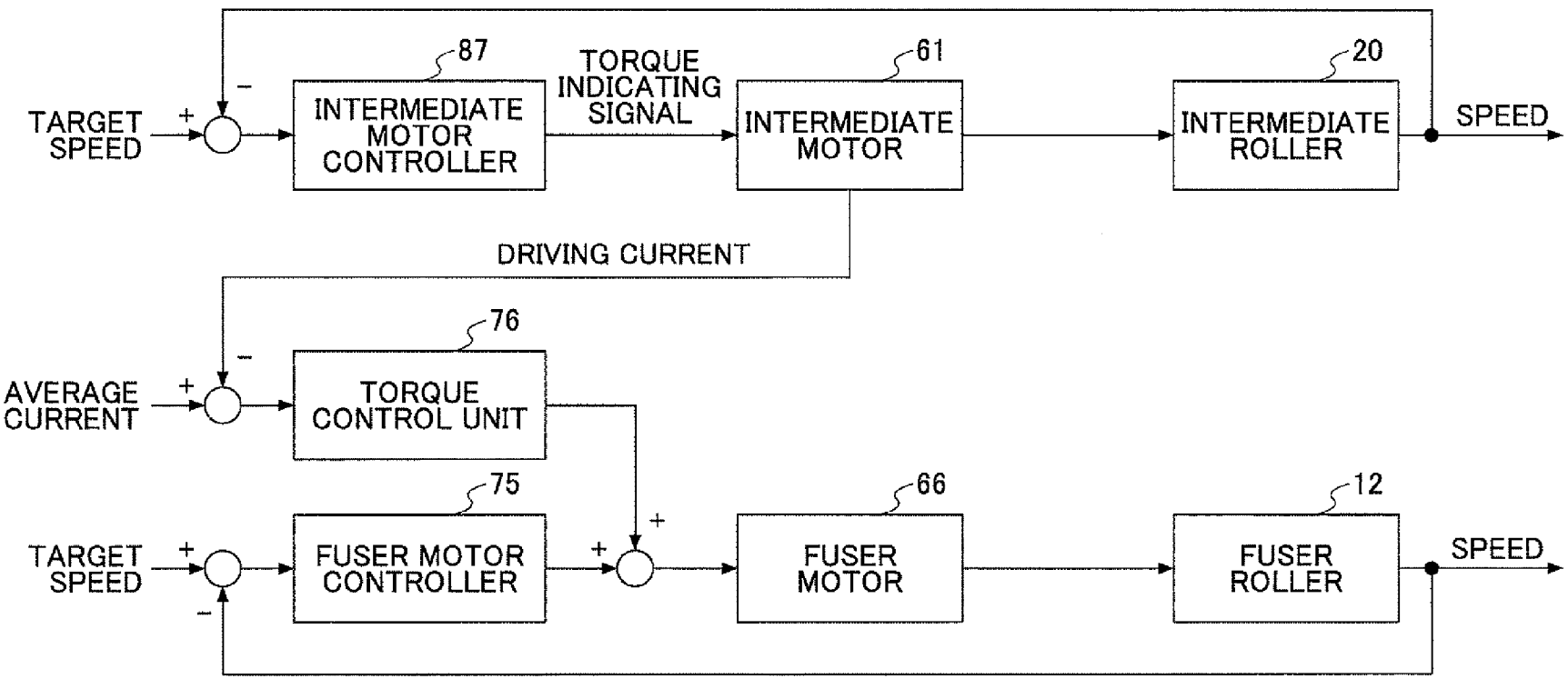
FIG. 21B is an example control block chart of the control device of the image forming apparatus of Embodiment 5.
Figure 21C:
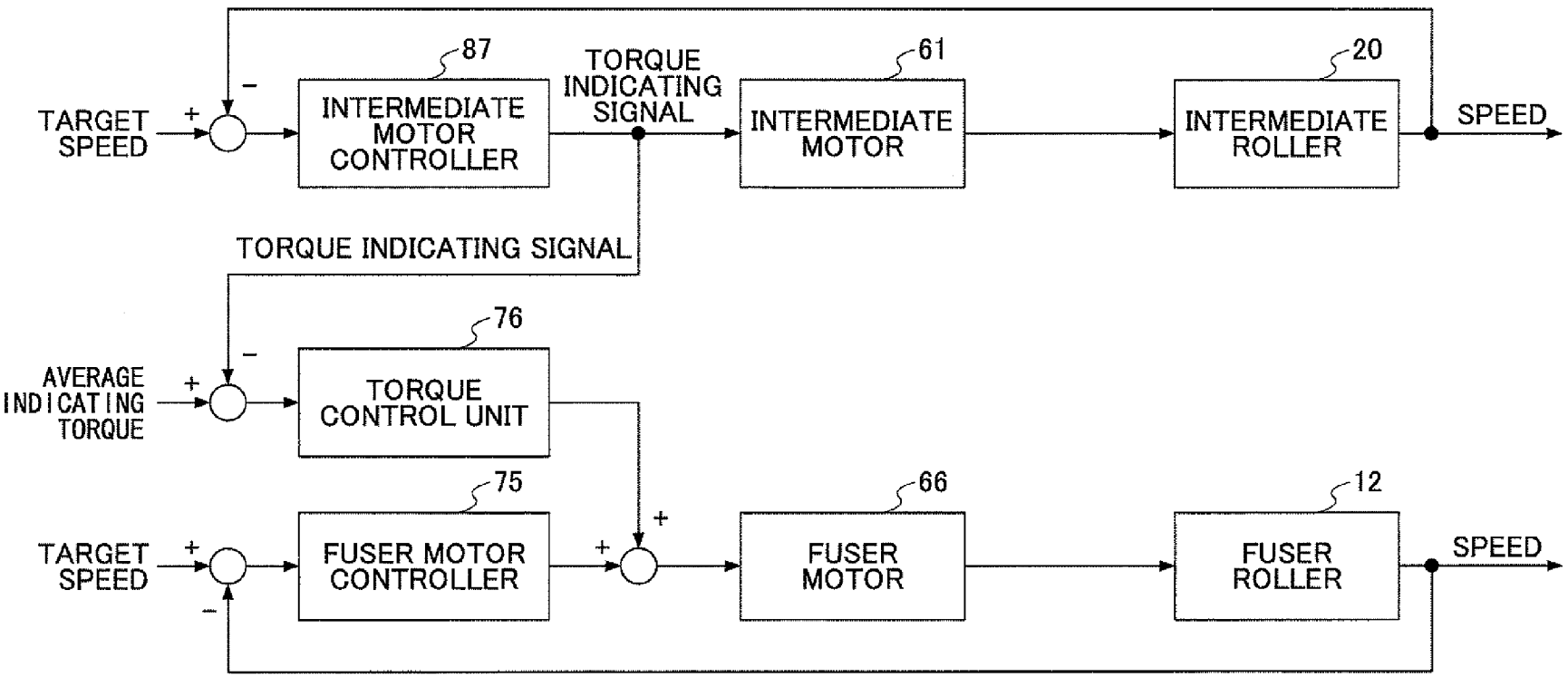
FIG. 21C is an example control block chart of the control device of the image forming apparatus of Embodiment 5.

FIG. 21A, FIG. 21B and FIG. 21C illustrate examples of control block charts of the control device 200 of an image forming apparatus 100 of Embodiment 5.

Referring to FIG. 21A, FIG. 21B and FIG. 21C, the same reference symbols are attached to the same portions as those in FIG. 10, and descriptions of these portions are omitted.

Referring to FIG. 21A, the torque sensor 67 is not provided, and an average torque $T_{av}$ and a calculated torque are used in controlling torques. The torque control unit 76 provides a torque deviation $T_C$ between the average torque and a calculated torque calculated from a driving current to a fuser motor controller 75 instead of the torque value detected by the torque sensor 67. The calculated torque is similar to the torque value detected by the torque sensor as described in Embodiment 4. The fuser motor controller 75 may control the rotational speed of a fuser motor 66 to null the torque deviation $T_C$.

The calculated torque is obtained by multiplying the driving current of an intermediate motor acquired by the torque control unit 76 by a motor constant. The average torque is an average value of calculated torques acquired when an intermediate roller 20 solely carries the recording paper 53.

Referring to FIG. 21B, an average current and a driving current are input in the torque control unit 76. The torque control unit 76 acquires a current deviation from the average current and the driving current instead of the torque value detected by the torque sensor 67, and provides the current deviation to the fuser motor controller 75. The fuser motor controller 75 may control the rotational speed of the fuser motor 66 to null the current deviation.

The average current is an average value of driving currents acquired by the torque control unit 76 from an intermediate motor 61 while the intermediate roller 20 solely carries the recording paper 53.

Referring to FIG. 21C, an average indicating torque and a torque indicating signal are input in the torque control unit 76. The torque control unit 76 acquires a torque deviation $T_C$ between the average indicating torque and the torque indicating signal and provides the torque deviation $T_C$ to the fuser motor controller 75 instead of the torque value detected by the torque sensor 67. The fuser motor controller 75 may control the rotational speed of the fuser motor 66 to null the torque deviation $T_C$.

The torque indicating signal is obtained by converting a speed to be indicated from an intermediate motor controller 87 to an intermediate motor 61 to a torque value. The average indicating torque is the average value of the torque indicating signals when the intermediate roller 20 solely carries the recording paper 53.

The image forming apparatus 100 of Embodiment 5 calculates the torque deviation $T_C$ exchanged between the intermediate roller 20 and the fuser roller 12 from the calculated torque, the driving current, or the torque indicating signal without using the torque sensor 67, and the rotational speed of the fuser motor 66 is corrected so that the torque deviation $T_C$ or the current deviation becomes null.

Embodiment 6

In Embodiment 6, a control without using the torque sensor 67 of Embodiment 4 is applicable to a control of a resist roller 33.

Figure 22A:
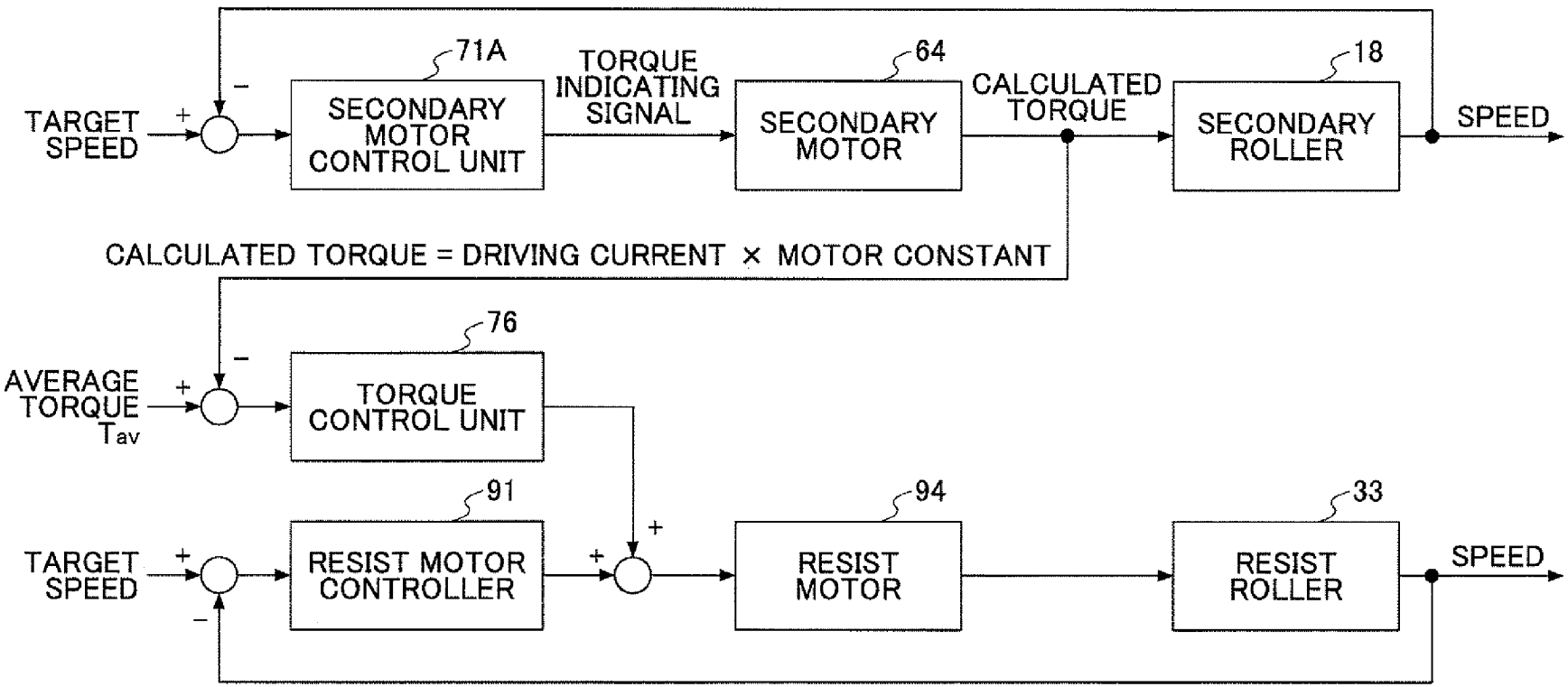
FIG. 22A is an example control block chart of the control device of the image forming apparatus of Embodiment 6.
Figure 22B:
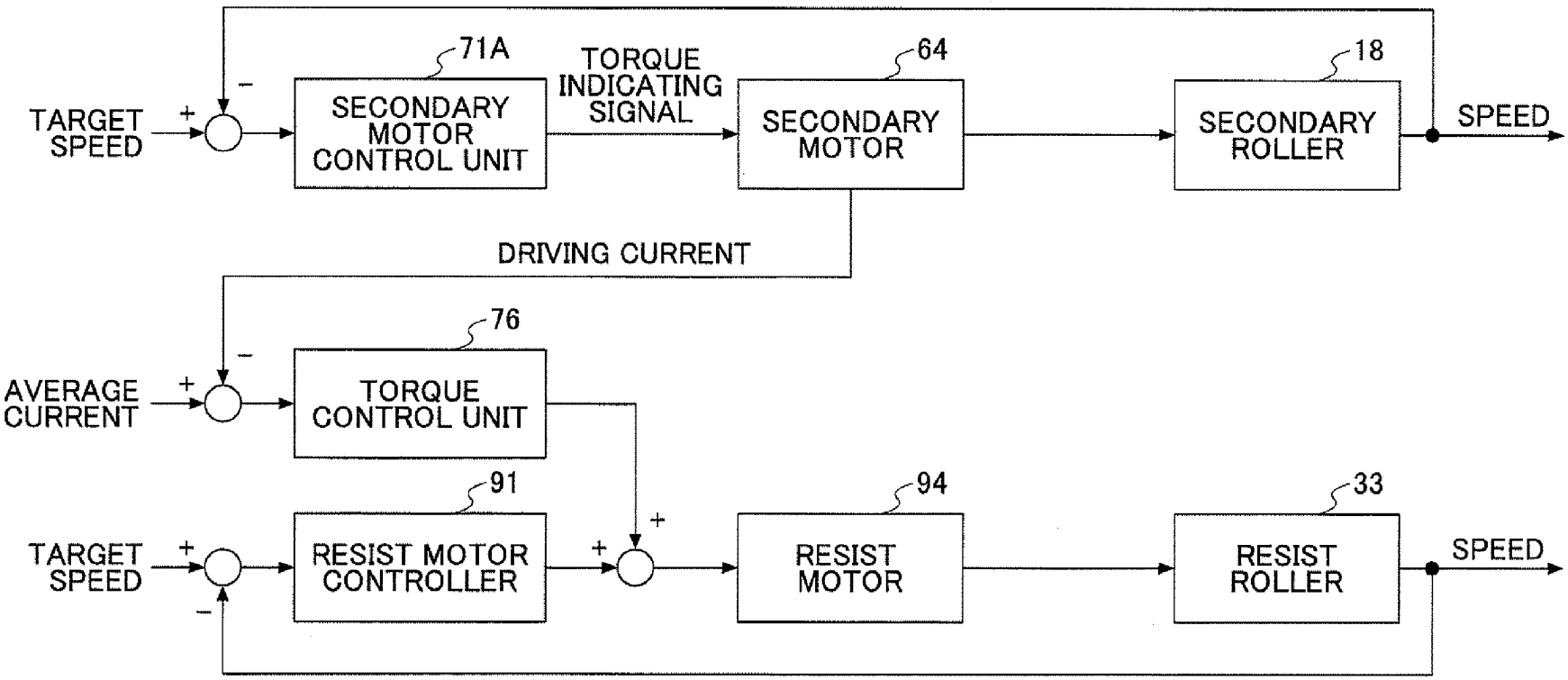
FIG. 22B is an example control block chart of the control device of the image forming apparatus of Embodiment 6.

FIG. 22A, FIG. 22B and FIG. 220 illustrate examples of control block charts of a control device 200 of an image forming apparatus 100 of Embodiment 6. Referring to FIG. 22A, FIG. 22B and FIG. 220, the same reference signs are attached to the same portions as those in FIG. 13, and descriptions of these portions are omitted.

Referring to FIG. 22A, the torque sensor 67 is not provided, and an average torque $T_{av}$ and a calculated torque are input in a torque control unit 76. The torque control unit 76 provides a torque deviation $T_C$ between the average torque $T_{av}$ and the calculated torque calculated from a driving current to a resist motor controller 91 instead of the torque value detected by the torque sensor 67. The resist motor controller 91 may control the rotational speed of a resist motor 94 to null the torque deviation $T_C$. The average torque $T_{av}$ and the calculated torque are the same as those illustrated in FIG. 16.

Referring to FIG. 22B, an average current and a driving current are input in the torque control unit 76. The torque control unit 76 acquires a current deviation from the average current and the driving current instead of the torque value detected by the torque sensor 67, and provides the current deviation to the resist motor controller 91. The resist motor controller 91 may control the rotational speed of a resist motor 94 to null the torque deviation $T_C$. The average current and the driving current are the same as those illustrated in FIG. 18.

Figure 22C:
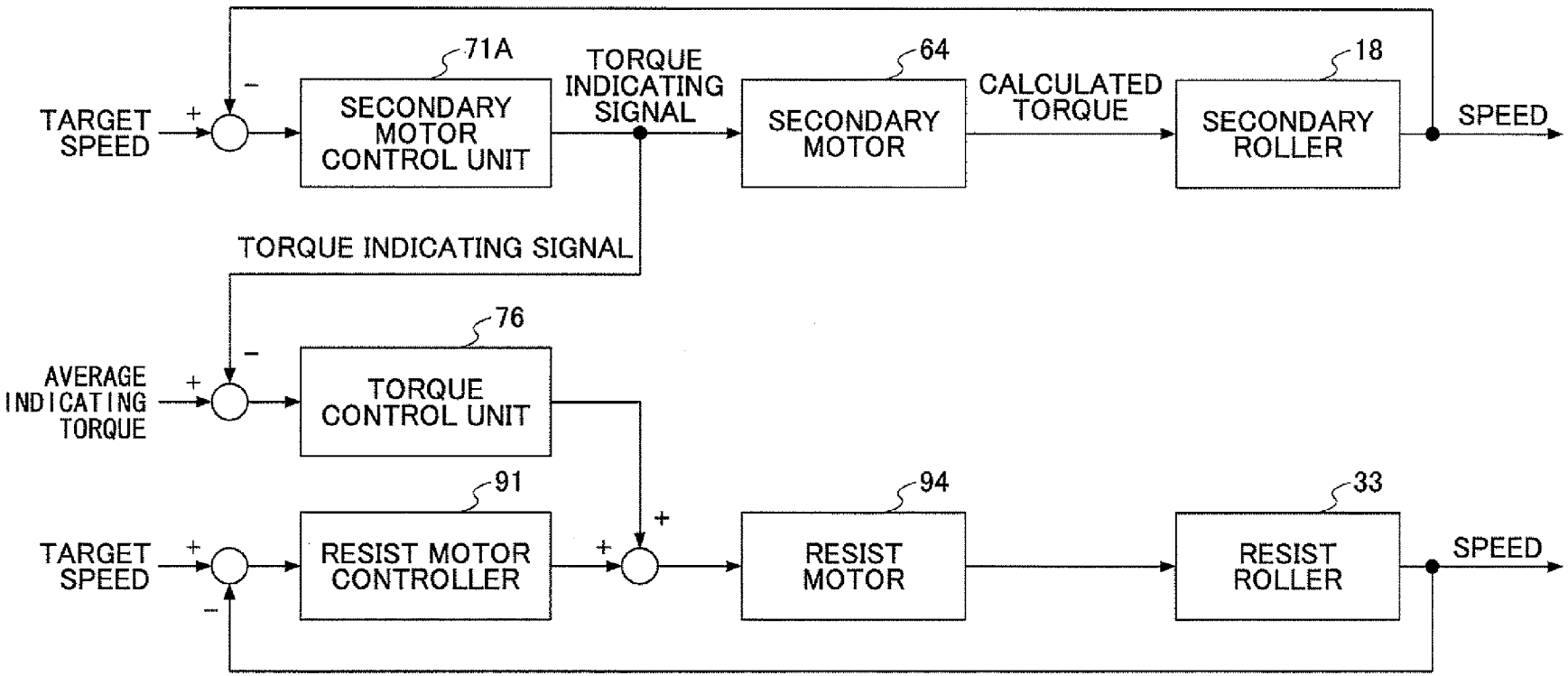
FIG. 22C is an example control block chart of the control device of the image forming apparatus of Embodiment 6.

Referring to FIG. 22C, an average indicating torque and a torque indicating signal are input in the torque control unit 76. The torque control unit 76 acquires a torque deviation $T_C$ between the average indicating torque and the torque indicating signal and provides the torque deviation $T_C$ to the resist motor controller 91 instead of the torque value detected by the torque sensor 67. The resist motor controller 91 may control the rotational speed of a resist motor 94 to null the torque deviation $T_C$. The average indicating torque and the torque indicating signal are the same as those illustrated in FIG. 19.

As described, the image forming apparatus 100 of Embodiment 6 calculates the torque deviation $T_C$ exchanged between the secondary roller 18 and the resist roller 33 from the calculated torque, the driving current, or the torque indicating signal without using the torque sensor 67, and the rotational speed of the resist motor 94 is corrected so that the torque deviation $T_C$ or the current deviation becomes null.

The carrying apparatus, the image forming apparatus, the carried medium carrying method, and the computer readable medium storing the computer program in which an exchange of torques between two rollers is reduced are provided.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made thereto without departing from the spirit and scope of the invention.

This patent application is based on Japanese Priority Patent Application No. 2009-210978 filed on Sep. 11, 2009 and Japanese Priority Patent Application No. 2010-169709 filed on Jul. 28, 2010, the entire contents of which are hereby incorporated herein by reference.

What is claimed is:

1. A carrying apparatus comprising:

a first rotating unit configured to carry a sheet-like carried medium in a rotating direction;

a second rotating unit configured to carry the sheet-like carried medium in the rotating direction, the second rotating unit being arranged in an upper or lower stream side of the first rotating unit;

a first driving unit configured to rotate the first rotating unit;

a second driving unit configured to rotate the second rotating unit;

a first rotational speed detecting unit configured to detect a first rotational speed of the first rotating unit;

a second rotational speed detecting unit configured to detect a second rotational speed of the second rotating unit;

a first rotational speed controlling unit configured to control the first rotational speed to be a first target speed;

a second rotational speed controlling unit configured to control the second rotational speed to be a second target speed; and a torque information acquiring unit configured to acquire torque information of torque acting on the first rotating unit, wherein the second rotational speed controlling unit controls the second rotational speed of the second driving unit rotating the second rotating unit in response to a comparison result between the torque information of the torque acting on the first rotating unit acquired by the torque information acquiring unit when the sheet-like carried medium is solely carried by the first rotating unit and the torque information of the torque acting on the first rotating unit acquired by the torque information acquiring unit when the sheet-like carried medium is carried by the first rotating unit and the second rotating unit.

2. The carrying apparatus according to claim 1, wherein the torque information is a driving current of the first driving unit.

3. The carrying apparatus according to claim 1, wherein the torque information is acquired by multiplying a driving current of the first driving unit by a predetermined constant.

4. The carrying apparatus according to claim 1, wherein the torque information is a torque indicating signal indicated by the first rotational speed controlling unit to the first driving unit.

5. The carrying apparatus according to claim 1, wherein the torque information is a value detected by a torque sensor which detects a torque acting on the first rotating unit.

6. The carrying apparatus according to claim 1, further comprising:

a torque estimating unit configured to estimate an exchange torque exchanged between the first rotating unit and the second rotating unit via the sheet-like carried medium by comparing the torque information acquired by the torque information acquiring unit when the sheet-like carried medium is solely carried by the first rotating unit and the torque information acquired by the torque information acquiring unit when the sheet-like carried medium is carried by the first rotating unit and the second rotating unit.

7. The carrying apparatus according to claim 6, wherein the torque estimating unit estimates the exchange torque by comparing an average value of a plurality of torque information pieces acquired by the torque information acquiring unit when the sheet-like carried medium is solely carried by the first rotating unit with the torque information acquired by the torque information acquiring unit when the sheet-like carried medium is carried by the first rotating unit and the second rotating unit.

8. The carrying apparatus according to claim 6, wherein the torque estimating unit estimates the exchange torque by comparing the torque information acquired by the torque information acquiring unit before the sheet-like carried medium comes into the second rotating unit with the torque information acquired by the torque information acquiring unit when the sheet-like carried medium is carried solely by the first rotating unit for a predetermined period of time immediately after the sheet-like carried medium comes into the second rotating unit from when the sheet-like carried medium is carried solely by the first rotating unit.

9. The carrying apparatus according to claim 6, wherein the torque estimating unit starts to estimate the exchange torque after the sheet-like carried medium comes into the first rotating unit and before the sheet-like carried medium comes into the second rotating unit, and the second rotational speed controlling unit controls the second rotational speed using the second driving unit in response to the exchange torque.

10. The carrying apparatus according to claim 6, wherein the torque estimating unit continues to estimate the exchange torque after an end portion of the sheet-like carried medium passes the first rotating unit, and the second rotational speed controlling unit controls the second rotational speed using the second driving unit in response to the exchange torque.

11. The carrying apparatus according to claim 6, wherein the torque estimating unit stores predetermined torque information instead of the torque information acquired by the torque information acquiring unit when the sheet-like carried medium is solely carried by the first rotating unit.

12. The carrying apparatus according to claim 1, wherein the first rotating unit receives via an endless belt a torque influence from a rotating body which directly carries the sheet-like carried medium or a rotating body which exchanges the torque influence via the second rotating unit and the sheet-like carried medium.

13. The carrying apparatus according to claim 1, wherein the first rotating unit is a secondary roller, and the second rotating unit is a fuser roller.

14. The carrying apparatus according to claim 1, wherein the first rotating unit is an intermediate roller, and the second rotating unit is a fuser roller.

15. The carrying apparatus according to claim 1, wherein the first rotating unit is a secondary roller, and the second rotating unit is a resist roller.

16. An image forming apparatus comprising:

the carrying apparatus according to claim 1; and an image forming unit configured to form an image on the sheet-like carried medium.

17. A carrying method of carrying a sheet-like carried medium comprising:

carrying a sheet-like carried medium with a first rotating unit in a rotating direction;

carrying the sheet-like carried medium with a second rotating unit arranged in an upper or lower stream side of the first rotating unit in the rotating direction;

rotating the first rotating unit;

rotating the second rotating unit;

detecting a first rotational speed of the first rotating unit;

detecting a second rotational speed of the second rotating unit;

controlling the first rotational speed to be a first target speed;

controlling the second rotational speed to be a second target speed; and acquiring torque information acting on the first rotating unit, wherein the controlling of the second rotational speed of the second driving unit rotating the second rotating unit is carried out in response to a comparison result between the torque information of the torque acting on the first rotating unit acquired when the sheet-like carried medium is solely carried by the first rotating unit and the torque information of the torque acting on the first rotating unit acquired when the sheet-like carried medium is carried by the first rotating unit and the second rotating unit.

18. A non-transitory computer readable medium storing a computer program containing instructions executable by a processor to perform carrying of a sheet-like carried medium comprising:

carrying a sheet-like carried medium with a first rotating unit in a rotating direction;

carrying the sheet-like carried medium with a second rotating unit arranged in an upper or lower stream side of the first rotating unit in the rotating direction;

rotating the first rotating unit;

rotating the second rotating unit;

detecting a first rotational speed of the first rotating unit;

detecting a second rotational speed of the second rotating unit;

controlling the first rotational speed to be a first target speed;

controlling the second rotational speed to be a second target speed; and acquiring torque information acting on the first rotating unit, wherein the controlling of the second rotational speed of the second driving unit rotating the second rotating unit is carried out in response to a comparison result between the torque information of the torque acting on the first rotating unit acquired when the sheet-like carried medium is solely carried by the first rotating unit and the torque information of the torque acting on the first rotating unit acquired when the sheet-like carried medium is carried by the first rotating unit and the second rotating unit.

* * * * *